US006970274B2

(12) United States Patent
Morita et al.

(10) Patent No.: US 6,970,274 B2
(45) Date of Patent: Nov. 29, 2005

(54) DISPLAY DEVICE AND DRIVING METHOD OF THE SAME

(75) Inventors: Keizo Morita, Kawasaki (JP); Ken-ichi Nakabayashi, Kawasaki (JP)

(73) Assignee: Sharp Kabushiki Kaisha, Osaka (JP)

( * ) Notice: Subject to any disclaimer, the term of this patent is extended or adjusted under 35 U.S.C. 154(b) by 967 days.

(21) Appl. No.: 09/774,406

(22) Filed: Jan. 31, 2001

(65) Prior Publication Data

US 2002/0075248 A1 Jun. 20, 2002

(30) Foreign Application Priority Data

Jul. 12, 2000 (JP) ..... 2000-211661

(51) Int. Cl.[7] ..... H04N 1/04

(52) U.S. Cl. ..... 358/474; 358/506; 358/513; 358/514; 382/132; 345/205; 345/206

(58) Field of Search ..... 358/474, 506, 358/513, 514, 530, 482; 382/132; 345/205, 345/206, 52, 90, 87, 92, 211

(56) References Cited

U.S. PATENT DOCUMENTS 5,712,652 A * 1/1998 Sato et al. ..... 345/90
5,774,100 A * 6/1998 Aoki et al. ..... 345/87
5,936,596 A * 8/1999 Yoshida et al. ..... 345/9
6,529,618 B1 * 3/2003 Ohara et al. ..... 382/132
2002/0047838 A1 * 4/2002 Aoki et al. ..... 345/205

FOREIGN PATENT DOCUMENTS

| | | |
|---|---|---|
| JP | 63-116190 | 5/1988 |
| JP | 6-67200 | 3/1994 |
| JP | 8-110531 | 4/1996 |
| JP | 2973969 | 9/1999 |

* cited by examiner

*Primary Examiner*—Jerome Grant, II
*Assistant Examiner*—Negussie Worku
(74) *Attorney, Agent, or Firm*—Greer, Burns & Crain, Ltd

(57) ABSTRACT

A display device has a display section having scanning lines, and first and second scanning drivers having output lines for supplying scanning signals to the two ends of the scanning lines in the display section. When the potential of at least one of the output lines of the first or second scanning driver is fixed or unfixed due to an error in the first or second scanning driver, the output line at the fixed or unfixed potential is disconnected from the corresponding scanning line in the display section.

20 Claims, 27 Drawing Sheets

DISPLAY DEVICE AND DRIVING METHOD OF THE SAME

CROSS-REFERENCE TO RELATED APPLICATIONS

This application is based upon and claims priority of Japanese Patent Applications No. 2000-211661, filed on Jul. 12, 2000, the contents being incorporated herein by reference.

BACKGROUND OF THE INVENTION

1. Field of the Invention

The present invention relates to display devices and driving methods of the devices, particularly to display devices that make a display in accordance with a scanning signal supplied from a scanning driver, and driving methods of the devices.

2. Description of the Related Art

In recent research and development of liquid crystal display devices, keen competition is held for technologies for cost reduction. In particular, a technique of forming a polysilicon thin-film transistor by a low-temperature process makes it possible to form not only a display area but also a peripheral circuit (e.g., a driver) on an inexpensive glass substrate. This technique has received a great deal of attention because the conventional cost of mounting driver ICs (Integrated Circuits) is reduced, and large cost reduction can be expected. Attempts have been made to form a polysilicon thin-film transistor on a glass substrate to manufacture a large and highly precise liquid crystal display device.

FIG. 22 shows the structure of a liquid crystal display device according to the first prior art. A display area 100 has two-dimensionally arrayed thin-film transistors. Each thin-film transistor controls display on the corresponding pixel. A first scanning driver 101*a* is arranged on the left side of the display area 100, while a second scanning driver 101*b* is arranged on the right side of the display area 100. The first and second scanning drivers 101*a* and 101*b* supply identical scanning signals to two ends of each scanning line of the display area 100 through n output lines GL1 to GLn and n output lines GR1 to GRn, respectively. First and second data drivers 102*a* and 102*b* are arranged on the upper and lower sides of the display area 100 to supply data signals to the display area 100.

A disconnection point 103 disconnects, in the display area 100, a scanning line for connecting the output line GL3 of the first scanning driver 101*a* and the output line GR3 of the second scanning driver 101*b*. In this case, since a scanning signal is supplied from the first scanning driver 101*a* to a display area 103*a*, display in the display area 103*a* is enabled. On the other hand, a scanning signal is supplied from the second scanning driver 101*b* to a display area 103*b*, so display in the display area 103*b* is enabled. That is, even when disconnection occurs at the disconnection point 103, display is enabled in both the display areas 103*a* and 103*b*. For this purpose, the two, first and second scanning drivers 101*a* and 101*b* are prepared.

Along with the recent increase in resolution of liquid crystal display devices, the numbers of output lines GL1 to GLn and GR1 to GRn of the scanning drivers 101*a* and 101*b* are increasing. As a consequence, defects during the manufacturing process readily occur in the scanning drivers 101*a* and 101*b* at high probability.

For example, the output line GR3 may be short-circuited to a power supply line or a ground line at a short-circuit point 104 in the scanning driver 101*b* due to a defect on the manufacturing process, as shown in FIG. 23. In this case, the output line GR3 in the scanning driver 101*b* is fixed to the power supply potential or ground potential, so no normal scanning signal is supplied from the scanning driver 101*b* to the display area 100. As a result, the right region of a horizontal line in the display area 100, which corresponds to the output line GR3, always displays white or black, and normal display is impeded.

As described above, even when the display area 100 has no defect, a defect in the scanning driver 101*a* or 101*b* makes the liquid crystal display device defective because the display area and scanning drivers are formed on a single glass substrate. A technique of correcting a defect in the scanning driver 101*a* or 101*b* has been proposed. This technique will be described next.

FIG. 24 shows the structure of a liquid crystal display device according to the second prior art disclosed in Japanese Patent Application Laid-open No. 6-67200. The liquid crystal display device of the second prior art is constructed by adding n-channel MOS (Metal Oxide Semiconductor) transistors 111*a* and 111*b* to the liquid crystal display device of the first prior art (FIGS. 22 and 23). A control signal is supplied to the gates of the transistors 111*a* through a control signal terminal CL. The sources and drains of the transistors 111*a* are connected to output lines GL1 to GLn of a first scanning driver 101*a* and the scanning lines in a display area 100, respectively. Similarly, a control signal is supplied to the gates of the transistors 111*b* through a control signal terminal CR. The sources and drains of the transistors 111*b* are connected to output lines GR1 to GRn of a second scanning driver 101*b* and the scanning lines in the display area 100, respectively.

Assume that it is detected after manufacturing the liquid crystal display device that the output line GR2 short-circuits to the power supply line or ground line at a short-circuit point 112 in the second scanning driver 101*b*. In this case, a high-level voltage is applied to the control signal terminal CL, and a low-level voltage is applied to the control signal terminal CR.

Consequently, the high-level voltage is applied to the gates of all of the n transistors 111*a*, and the n transistors 111*a* are turned on to connect the output lines GL1 to GLn of the scanning driver 101*a* to the scanning lines in the display area 100. A scanning signal is supplied from the scanning driver 101*a* to the display area 100.

On the other hand, the low-level voltage is applied to the gates of all of the n transistors 111*b*, and the n transistors 111*b* are turned off to disconnect the output lines GR1 to GRn of the scanning driver 101*b* from the scanning lines in the display area 100. No scanning signal is supplied from the scanning driver 101*b* to the display area 100.

That is, since a normal scanning signal is supplied only from the scanning driver 101*a* to the display area 100, normal display is possible. However, Japanese Patent Application Laid-open No. 6-67200 discloses no method of detecting the short-circuit point 112. Additionally, even if the defect in the second line can be visually detected on the display screen, it cannot be determined whether the defect in the second line is due to a short circuit in the scanning driver 101*a* or in the scanning driver 101*b*. Without presenting the determination method, which scanning driver has a defect, the first scanning driver 101*a* or second scanning driver 101*b*, cannot be known, and the voltage levels for the control signal terminals CL and CR cannot be determined.

Furthermore, as shown in FIG. 25, the output line GR2 may short-circuit at a short-circuit point 113 in the second scanning driver 101*b*, and simultaneously, a scanning line may be disconnected at a disconnection point 114 in the display area 100. In this case, assume that a high-level voltage is applied to the control signal terminal CL, and a low-level voltage is applied to the control signal terminal CR to correct the short-circuit point 113, as described above.

As a result, although a scanning signal is supplied from the first scanning driver 101*a* to a display area 114*a*, no scanning signal is supplied from either of the scanning driver 101*a* and 101*b* to a display area 114*b*, so normal display is disabled in the display area 114*b*.

Also, as shown in FIG. 26, assume a case wherein the output line GL4 short-circuits at a short-circuit point 115 in the first scanning driver 101*a*, the output line GR1 short-circuits at a short-circuit point 116 in the second scanning driver 101*b*, and a scanning line is disconnected at a disconnection point 117 in the display area 100.

To correct the short-circuit point 116, a low-level voltage is applied to the control signal terminal CR, and a high-level voltage is applied to the control signal terminal CL. In this case, however, since the transistors 111*b* are turned off, and no scanning signal is supplied to a display area 117*b*, normal display is disabled in the display area 117*b*. In addition, since the output line GL4 short-circuits at the short-circuit point 115 in the first scanning driver 101*a*, no normal scanning signal is supplied to the fourth scanning line in the display area 100 from either of the second scanning driver 101*b* and the first scanning driver 101*a*. For this reason, the fourth line cannot be normally displayed.

On the other hand, to correct the short-circuit point 115, a low-level voltage is applied to the control signal terminal CL, and a high-level voltage is applied to the control signal terminal CR. In this case, however, since the transistors 111*a* are turned off, and no scanning signal is supplied to a display area 117*a*, normal display is disabled in the display area 117*a*. In addition, since the output line GR1 short-circuits at the short-circuit point 116 in the second scanning driver 101*b*, no normal scanning signal is supplied to the first line in the display area 100 either from the first scanning driver 101*a* nor from the second scanning driver 101*b*. For this reason, the first line cannot be normally displayed.

The above defects cannot be completely corrected. Additionally, Japanese Patent Application Laid-open No. 6-67200 presents no defect detection method, as described above. A publication that presents a defect detection method will be described next.

FIG. 27 shows the structure of a liquid crystal display device according to the third prior art disclosed in Japanese Patent No. 2973969. The liquid crystal display device of the third prior art is constructed by adding n-channel MOS transistors 121*a* and 121*b* to the liquid crystal display device of the first prior art (FIGS. 22 and 23).

Output lines GL1 to GLn of a first scanning driver 101*a* are connected to the gates of the n transistors 121*a*. An input terminal Lin and output terminal Lout are connected to the sources and drains of the n transistors 121*a*.

On the other hand, output lines GR1 to GRn of a second scanning driver 101*b* are connected to the gates of the n transistors 121*b*. An input terminal Rin and output terminal Rout are connected to the sources and drains of the n transistors 121*b*.

When a check signal is input to the input terminal Lin, and the signal from the output terminal Lout is checked, the state of a scanning signal supplied to the gates of the transistors 121*a* can be known. In addition, when a check signal is input to the input terminal Rin, and the signal from the output terminal Rout is checked, the state of a scanning signal supplied to the gates of the transistors 121*b* can be known. However, the third prior art discloses only the check method and no correction method.

As described above, the second prior art presents a correction method but no check method. The correction method has limitations and cannot correct the defects shown in FIGS. 25 and 26.

The third prior art discloses a check method but no correction method. Details of the check method are not presented, and all defects cannot always be detected. Even if a defect can be detected, how to correct the defect is not described.

SUMMARY OF THE INVENTION

It is an object of the present invention to provide a display device capable of detecting a defect with which the potential of an output line of a scanning driver is fixed or unfixed and automatically correcting the defect, and a driving method of the device.

It is another object of the present invention to provide a display device capable of reliably detecting a defect with which the potential of an output line of a scanning driver is fixed or unfixed, and a driving method of the device.

It is still another object of the present invention to provide a display device capable of reliably correcting a defect with which the potential of an output line of a scanning driver is fixed or unfixed, and a driving method of the device.

A display device according to the present invention comprises a display section with scanning lines, and a scanning driver with output lines for supplying scanning signals to the scanning lines in the display section. When the potential of at least one of the output lines of the scanning driver is fixed or unfixed due to an error in the scanning driver or the like, the output line with the fixed or unfixed potential is disconnected from the corresponding scanning line in the display section.

When the potential of an output line of the scanning driver is fixed or unfixed, only the output line with the fixed or unfixed potential can be disconnected from the corresponding scanning line in the display section. For example, when an output line of the first scanning driver is disconnected from the corresponding scanning line in the display section, a normal scanning signal is supplied from the corresponding output line of the second scanning driver to the scanning line in the display section. Instead of disconnecting all the output lines of the first or second scanning driver from all the scanning lines in the display section, only the output line with the fixed potential can be disconnected from the scanning line in the display section. For this reason, the normal output lines of the first or second scanning driver and the scanning lines in the display section are connected, so normal display can be performed. In addition, since it is determined individually for the first and second scanning drivers whether the potential of an output line is fixed or unfixed, and the output lines are individually disconnected from the scanning lines as needed, even defects as shown in FIGS. 25 and 26 can be corrected. That is, even when defects are present at portions, e.g., both of the first or second scanning driver and the display section have defects, or the first and second scanning drivers and display section have defects, the defects can be reliably detected and automatically corrected, so normal display can be performed.

Even when the scanning driver has a defect or the scanning driver and display section have defects, the defect can be automatically corrected, so normal display can be performed. In addition, since the automatic correction of the display device is possible, the yield of display devices can be increased, the productivity can be improved, and the cost of display devices can be reduced.

DETAILED DESCRIPTION OF THE PREFERRED EMBODIMENTS

Embodiments of the present invention will be described below with reference to drawings.

(First Embodiment)

Figure 1:
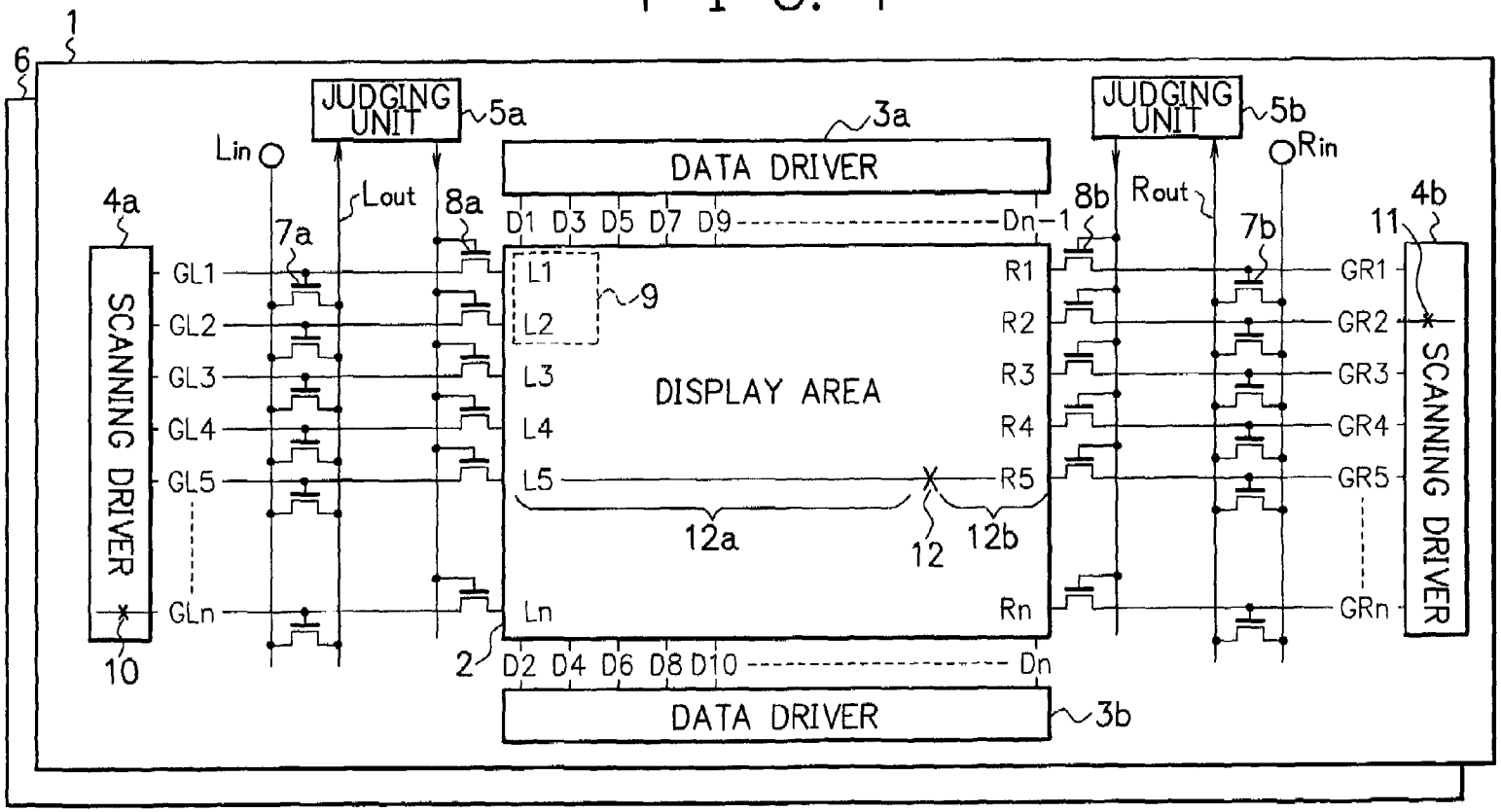
FIG. 1 is a block diagram showing the structure of a liquid crystal display device according to the first embodiment of the present invention.

FIG. 1 is a block diagram showing the structure of a liquid crystal display device according to the first embodiment of the present invention. When an output line in a first or second scanning driver 4*a* or 4*b* has a short circuit to the ground line or disconnection and is fixed at low level or unfixed, the liquid crystal display device according to the first embodiment can detect the defect and automatically correct it.

In addition to a display area 2, a first scanning driver 4*a*, a second scanning driver 4*b*, a first data driver 3*a*, and a second data driver 3*b*, judging units 5*a* and 5*b* and n-channel MOS transistors 7*a*, 7*b*, 8*a*, and 8*b* are integrally formed on a glass substrate 1. The space between the glass substrate 1 and a counter substrate 6 is filled with liquid crystal. Counter electrodes are formed on the entire surface of the counter substrate 6. The second to fifth embodiments to be described later also use similar counter substrates 6. All transistors to be described in this specification are polysilicon thin-film transistors.

Figure 2:
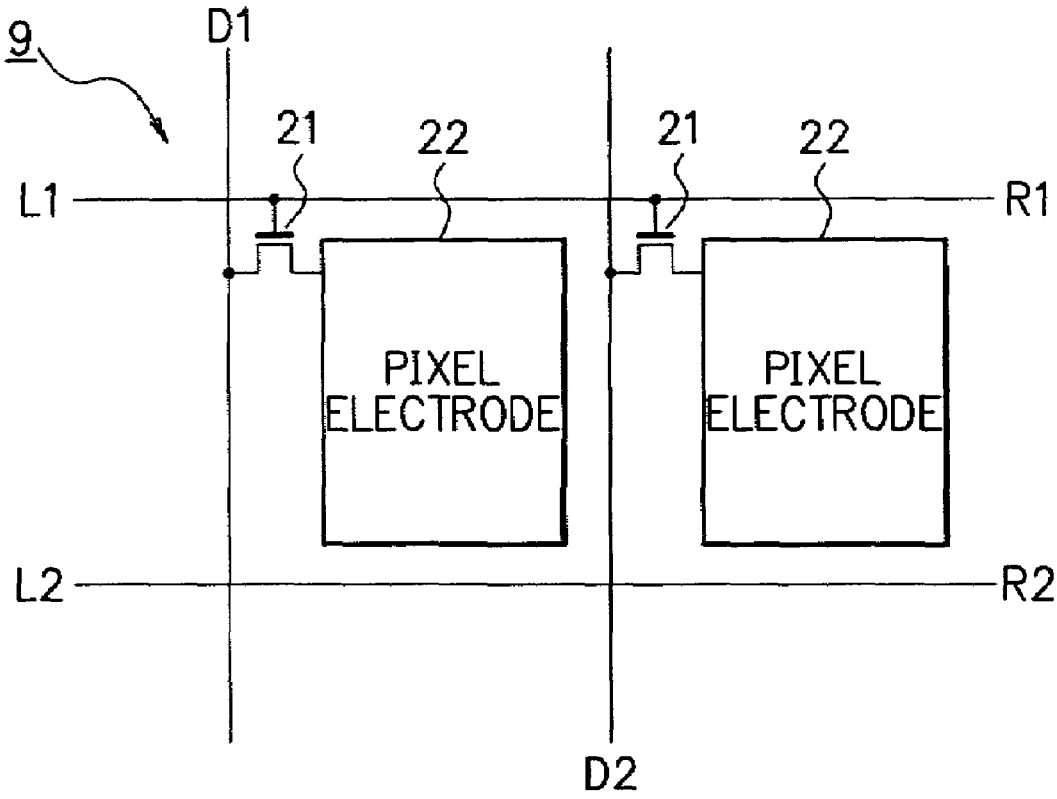
FIG. 2 is a circuit diagram showing the structure of a display area.

FIG. 2 shows a specific structure of a region 9 in the display area (display section) 2. The display area 2 has n-channel MOS transistors 21 arrayed in a two-dimensional matrix. A left-end portion L1 of a scanning line and a right-end portion R1 of the scanning line are connected to each other to form a first scanning line. A left-end portion L2 of another scanning line and a right-end portion R2 of this scanning line are connected to each other to form a second scanning line. In a similar way, a left-end portion Ln of a scanning line and a right-end portion Rn of this scanning line are connected to each other to form an nth scanning line. The gates of the transistors 21 are connected to the scanning lines (L1,R1) to (Ln,Rn) extending in the horizontal direction, and the sources and drains are connected to data lines D1 to Dn extending in the vertical direction and pixel electrodes 22, respectively. When a predetermined potential is applied to each pixel electrode 22, display on the corresponding pixel can be controlled.

Referring to FIG. 1, the first and second scanning drivers 4*a* and 4*b* are arranged on both sides of the display area 2 to sandwich the display area 2 and have output lines GL1 to GLn and GR1 to GRn to supply identical scanning signals to the ends of the scanning lines L1 to Ln and R1 to Rn in the display area 2.

The first scanning driver 4*a* is arranged on the left side of the display area 2 and has the n output lines GL1 to GLn. The output lines GL1 to GLn of the first scanning driver 4*a* are connected to the scanning lines L1 to Ln in the display area 2 through the n n-channel MOS transistors (switching units) 8*a*, respectively. That is, the sources and drains of the n transistors 8*a* are connected to the output lines GL1 to GLn and scanning lines L1 to Ln, respectively.

The second scanning driver 4*b* is arranged on the right side of the display area 2 and has the n output lines GR1 to GRn. The output lines GR1 to GRn of the second scanning driver 4*b* are connected to the scanning lines R1 to Rn in the display area 2 through the n n-channel MOS transistors (switching units) 8*b*, respectively. That is, the sources and drains of the n transistors 8*b* are connected to the output lines GR1 to GRn and scanning lines R1 to Rn, respectively.

The first and second data drivers 3*a* and 3*b* are arranged on two sides of the display area 2 to sandwich the display area 2. The first data driver 3*a* is arranged on the upper side of the display area 2 to supply data signals to the odd-numbered lines D1, D3, D5, . . . , Dn−1 in the display area 2. The second data driver 3*b* is arranged on the lower side of the display area 2 to supply data signals to the even-numbered lines D2, D4, D6, . . . , Dn in the display area 2. The first and second data drivers 3*a* and 3*b* need not be separated and may be integrated to one data driver. However, when the first and second data drivers 3*a* and 3*b* are separated, the wiring pitch of them can be made large. This relaxes the manufacturing process conditions and facilitates manufacturing.

The relationship between the scanning drivers 4*a* and 4*b* and the data drivers 3*a* and 3*b* will be described next. The first scanning driver 4*a* outputs a scanning signal for sequentially selecting the scanning lines (L1,R1) to (Ln,Rn) in the display area 2 to the output lines GL1 to GLn. The second scanning driver 4*b* similarly outputs a scanning signal for sequentially selecting the scanning lines (L1,R1) to (Ln,Rn) in the display area 2 to the output lines GR1 to GRn.

When the first scanning line (L1,R1) is selected, the data drivers 3*a* and 3*b* output data D1 to Dn corresponding to the first scanning line (L1,R1). When the second scanning line (L2,R2) is selected, the data drivers 3*a* and 3*b* output data D1 to Dn corresponding to the second scanning line (L2, R2). Subsequently, the data drivers 3*a* and 3*b* sequentially output data up to the n-th scanning line (Ln,Rn).

The gates of the n first check transistors (n-channel MOS transistors) 7*a* are connected to the output lines GL1 to GLn of the first scanning driver 4*a*, respectively. One of the source and drain of each of the n first check transistors 7*a* is connected to a check input terminal Lin, and the other is connected to the input terminal of the judging unit 5*a*.

A check signal is input to the input terminal Lin. When one of the output lines GL1 to GLn is selected, the transistor 7*a* connected to the selected output line is turned on. The transistor 7*a* then outputs (transmits) the check signal input from the input terminal Lin to the judging unit 5*a*. If the first scanning driver 4*a* is normal, the n transistors 7*a* are sequentially turned on from the transistor corresponding to the first output line GL1 to that corresponding to the n-th output line GLn.

A case wherein the first scanning driver 4*a* is normal will be described first. Each transistor 7*a* is turned on every time the scanning signal on the corresponding one of the output lines GL1 to GLn goes high (every time the output line is selected). Then, the judging unit 5*a* normally receives the check signal, determines that the scanning signal on the output lines GL1 to GLn of the first scanning driver 4*a* is normal, and outputs a high-level signal. This determination is done at the timing of each of the output lines GL1 to GLn.

The gates of the n switching transistors (n-channel MOS transistors) 8*a* are connected to the output terminal of the judging unit 5*a*. One of the source and drain of each of the n switching transistors 8*a* is connected to the corresponding one of the output lines GL1 to GLn of the scanning driver 4*a*, and the other is connected to the corresponding one of the scanning lines L1 to Ln in the display area 2.

When the judging unit 5*a* outputs a high-level signal, the n-channel transistors 8*a* are turned on to connect the output lines GL1 to GLn of the scanning driver 4*a* to the scanning lines L1 to Ln in the display area 2, respectively. Thus, the display area 2 can receive the scanning signal from the first scanning driver 4*a* and perform normal display.

A defect with which one or more output lines in the first scanning driver 4*a* short-circuit to the ground line, and the scanning signals on the output lines are fixed at low level, or a defect with which one or more output lines are disconnected and unfixed will be considered next. When a scanning signal is fixed at low level or unfixed, the transistor 7*a* corresponding to the scanning signal is kept off. The judging unit 5*a* cannot obtain the check signal input from the terminal Lin, and therefore determines that a predetermined one of the output lines GL1 to GLn of the first scanning driver 4*a* short-circuits to the ground line or is unfixed, and outputs a low-level signal. The judging unit 5*a* does this determination for each of the output lines GL1 to GLn and outputs a signal. That is, the judging unit 5*a* outputs a high-level signal at the timing of a normal output line and a low-level signal at the timing of an abnormal output line.

When the judging unit 5*a* outputs a low-level signal, the n-channel MOS transistors 8*a* are turned off to disconnect the output lines GL1 to GLn of the scanning driver 4*a* from the scanning lines L1 to Ln in the display area 2. For a normal output line, the judging unit 5*a* outputs a high-level signal, so the transistors 8*a* are turned on to connect the output lines GL1 to GLn to the scanning lines L1 to Ln. Thus, the display area 2 receives the scanning signal only from a normal output line of the first scanning driver 4*a*. For an abnormal output line, the display area 2 can receive the scanning signal from the second scanning driver 4*b* and perform normal display.

The first scanning driver 4*a*, the transistors 7*a* and 8*a*, and the first judging unit 5*a* have been described above. This also applies to the second scanning driver 4*b*, the transistors 7*b* and 8*b*, and the second judging unit 5*b*.

More specifically, the gates of the transistors 7*b* are connected to the output lines GR1 to GRn of the second scanning driver 4*b*. One of the source and drain of each of the transistors 7*b* is connected to a check input terminal Rin, and the other is connected to the input terminal of the judging unit 5*b*.

The gates of the transistors 8*b* are connected to the output of the judging unit 5*b*. One of the source and drain of each of the transistors 8*b* is connected to the corresponding one of the output lines GR1 to GRn of the second scanning driver 4*b*, and the other is connected to the corresponding one of the scanning lines R1 to Rn in the display area 2.

The transistors 7*b* switch in accordance with the scanning signals on the output lines GR1 to GRn of the second scanning driver 4*b*. The judging unit 5*b* determines in accordance with the switching states of the transistors 7*b* whether the output lines GR1 to GRn of the second scanning driver 4*b* are short-circuited to the ground line or unfixed and outputs the determination result. The transistors 8*b* switch connection between the output lines GR1 to GRn of the second scanning driver 4*b* and the scanning lines R1 to Rn in the display area 2 in accordance with the output from the judging unit 5*b*.

A case wherein the liquid crystal display device has three defects will be described next. As the first defect, the output line GLn in the first scanning driver 4*a* short-circuits to the ground line at a short-circuit point 10. As the second defect, the output line GR2 in the second scanning driver 4*b* short-circuits to the ground line at a short-circuit point 11. As the third defect, the scanning line (L5,R5) in the display area 2 is disconnected at a disconnection point 12.

In this case, the judging unit 5*a* determines that only the output line GLn of the first scanning driver 4*a* short-circuits to the ground line, and the remaining output lines GL1 to GLn−1 are normal. Only the transistor 8*a* corresponding to the n-th output line GLn is turned off, and the remaining transistors 8*a* corresponding to the output lines GL1 to GLn−1 are turned on.

The judging unit 5*b* determines that only the output line GR2 of the second scanning driver 4*b* short-circuits to the ground line, and the remaining output lines GR1 and GR3 to GRn are normal. Only the transistor 8*b* corresponding to the second output line GR2 is turned off, and the remaining transistors 8*b* corresponding to the output lines GR1 and GR3 to GRn are turned on.

As a consequence, the second scanning line (L2,R2) in the display area 2 receives the scanning signal only from the first scanning driver 4*a*, and the n-th scanning line (Ln.Rn) receives the scanning signal only from the second scanning driver 4*b*. The remaining scanning lines (L1,R1) and (L3, R3) to (Ln−1,Rn−1) receive the scanning signals from both of the first and second scanning drivers 4*a* and 4*b*.

Near the disconnection point 12, a display area 12*a* can perform normal display upon receiving the scanning signal from the first scanning driver 4*a*. On the other hand, a display area 12*b* can perform normal display upon receiving the scanning signal from the second scanning driver 4*b*. In this way, even when defects are present at the three points 10 to 12, all lines can be normally displayed.

Figure 3:
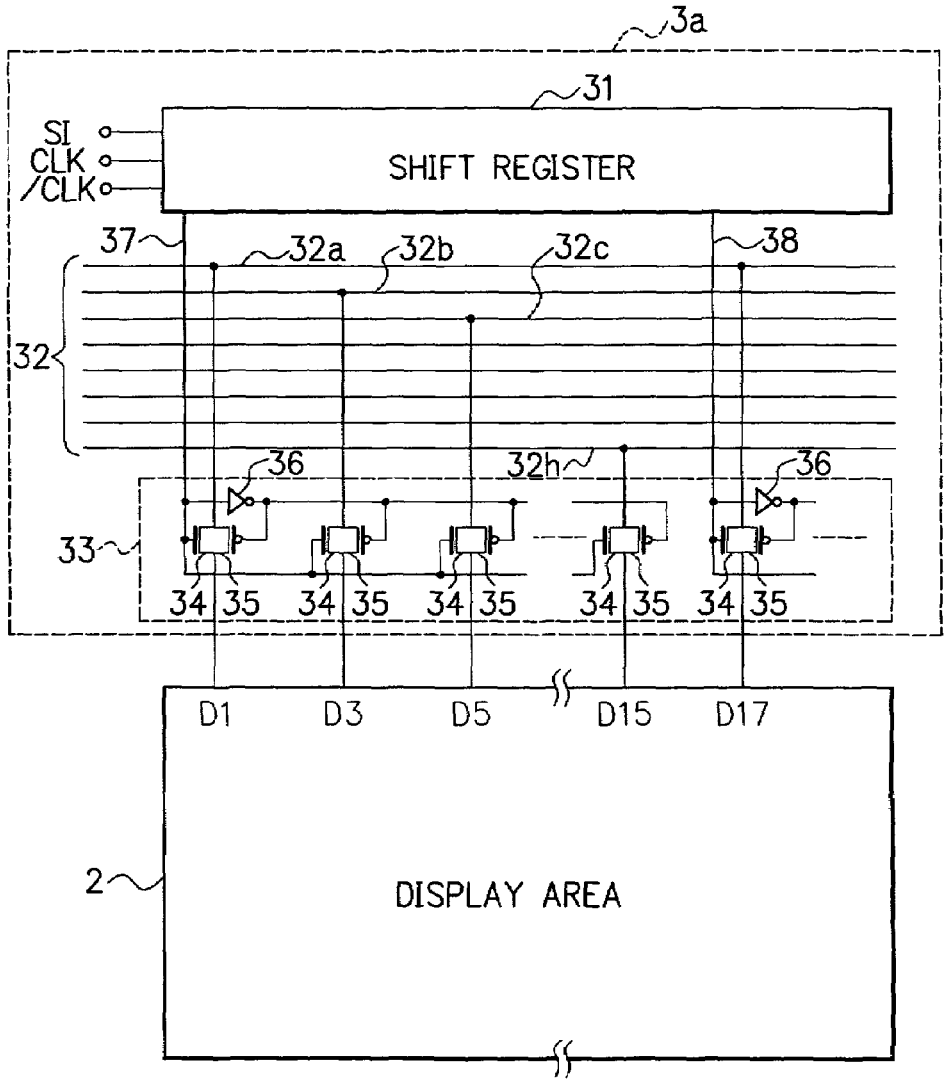
FIG. 3 is a circuit diagram showing the structure of a data driver.

FIG. 3 is a circuit diagram showing the structure of the data driver 3*a* shown in FIG. 1. The structure of the first data driver 3*a* will be described, though the second data driver 3*b* has the same structure as that of the first data driver 3*a*. The first data driver 3*a* has a shift register 31, a video analog line 32, and an analog switch 33.

The shift register 31 receives signals from three input terminals, i.e., a start signal terminal SI, a clock terminal CLK, and a clock bar (inversion) terminal /CLK, and sequentially outputs pulses from output lines 37, 38, . . . . First, the output line 37 is selected, and the output line 38 is selected next, so that the subsequent output lines are sequentially selected. There are not only the two output lines 37 and 38 but actually a number of output lines. The symbol "/" means a bar (inversion) signal.

The video analog line 32 comprises, e.g., eight video analog lines 32*a* to 32*h* and supplies, e.g., the analog voltages of data signals of 256 gray levels. In the analog switch 33, an n-channel MOS transistor 34 and a p-channel MOS transistor 35 constitute a switch, and eight switches arrayed in the horizontal direction construct one unit. More specifically, in the eight units at the left end, the output line 37 is connected to the gates of the n-channel MOS transistors 34, and also connected to the gates of the p-channel MOS transistors 35 through a logic inversion circuit (inverter) 36. In the next eight units on the right side, the output line 38 is connected to the gates of the n-channel MOS transistors 34, and also connected to the gates of the p-channel MOS transistors 35 through another logic inversion circuit (inverter) 36.

The sources and drains of the n-channel MOS transistors 34 and the p-channel MOS transistors 35 are connected to the video analog lines 32*a* to 32*h* and the data lines D1, D3, . . . , Dn−1 in the display area 2.

When the output line 37 is selected and goes high, the eight switch units at the left end in the analog switch 33 are turned on to connect the eight video analog lines 32*a* to 32*h* to the eight data lines D1, D3, . . . , D15, respectively, so eight data signals are supplied to the display area 2.

After the output line 37 goes low, new data signals are supplied to the video analog line 32, and the output line 38 is selected and goes high. The eight second switch units from the left end in the analog switch 33 are then turned on to connect the eight video analog lines 32*a* to 32*h* to the eight data lines D17, D19, . . . , D31, respectively, so new eight data signals are supplied to the display area 2. In the above way, data are sequentially supplied up to the data line Dn−1, and data supply for one line is ended. This operation is executed for each line in the display area 2.

Figure 4A:
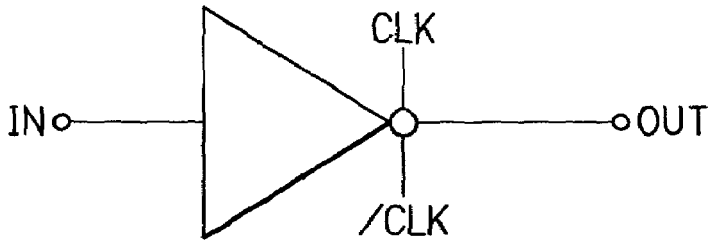
FIG. 4A is a view showing a clocked inverter.

FIG. 4A is a diagram showing a clocked inverter used in each of the scanning drivers 4*a* and 4*b* shown in FIG. 1. The clocked inverter inverts a signal input from an input terminal IN using the clock signal CLK and clock bar signal /CLK as control signals, and outputs the inverted signal from an output terminal OUT.

Figure 4B:
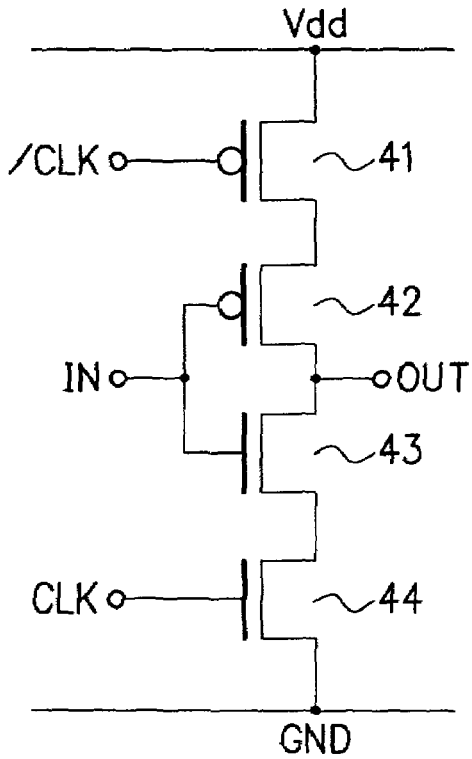
FIG. 4B is a circuit diagram showing the structure of the clocked inverter.

FIG. 4B is a circuit diagram showing the structure of the clocked inverter shown in FIG. 4A. A p-channel MOS transistor 41 has its gate connected to the clock bar signal terminal /CLK, its source connected to a positive potential Vdd, and its drain connected to the source of a p-channel MOS transistor 42. The p-channel MOS transistor 42 has its gate connected to the input terminal IN and its drain connected to the output terminal OUT. An n-channel MOS transistor 43 has its gate connected to the input terminal IN, its drain connected to the output terminal OUT, and its source connected to the drain of an n-channel MOS transistor 44. The n-channel MOS transistor 44 has its gate connected to the clock signal terminal CLK and its source connected to a ground potential GND.

Figure 5A:
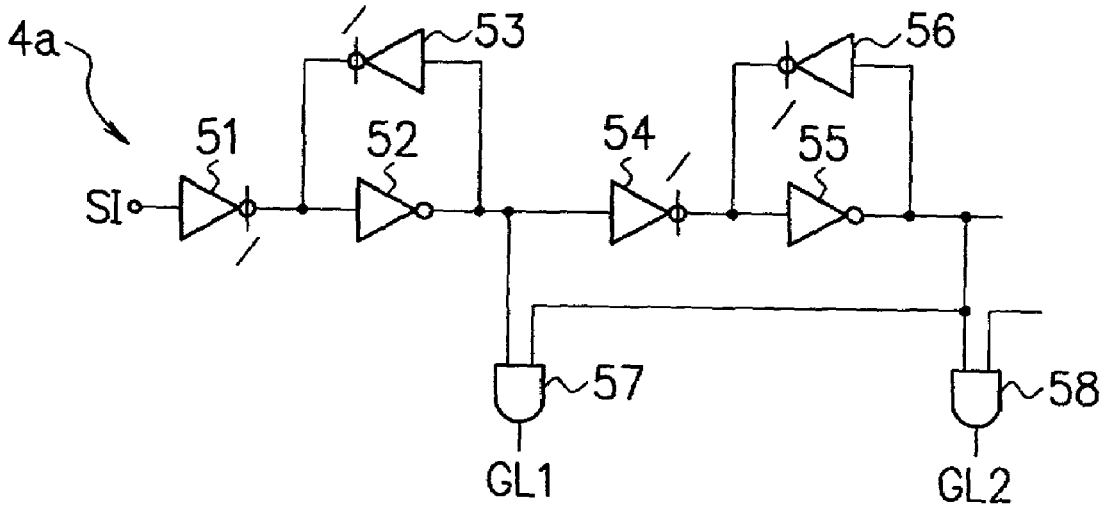
FIG. 5A is a circuit diagram showing the structure of a scanning driver.

FIG. 5A is a circuit diagram showing the structure of the first scanning driver 4*a* shown in FIG. 1. The structure of the first scanning driver 4*a* will be described below, though the structure of the second scanning driver 4*b* is the same as that of the first scanning driver 4*a*. In first clocked inverters 51 and 56, the positions of the clock signal terminal CLK and clock bar signal terminal /CLK are the same as in FIG. 4B. On the other hand, in second clocked inverters 53 and 54, the positions of the clock signal terminal CLK and clock bar signal terminal /CLK are opposite to those shown in FIG. 4B: the clock signal terminal CLK is connected to the gate of the transistor 41, and the clock bar signal terminal /CLK is connected to the gate of the transistor 44.

The clocked inverter 51 has its input connected to the start signal terminal SI and its output connected to the input of an inverter 52. The clocked inverter 53 has its input connected to the output of the inverter 52 and its output connected to the input to the inverter 52. The clocked inverter 54 has its input connected to the output of the inverter 52 and its output connected to the input of an inverter 55. The clocked inverter 56 has its input connected to the output of the inverter 55 and its output connected to the input of the inverter 55. The clocked inverters 51 and 53 and the inverter 52 construct an odd-numbered unit, and the clocked inverters 54 and 56 and the inverter 55 construct an even-numbered unit. The odd-numbered unit and even-numbered unit are alternately repeatedly connected in the horizontal direction on the right side of the drawing.

An AND circuit 57 performs an AND operation between the output from the inverter 52 and that from the inverter 55 and outputs the result to the first output line GL1. An AND circuit 58 performs an AND operation between the output from the inverter 55 and that from the next inverter and outputs the result to the second output line GL2.

Figure 5B:
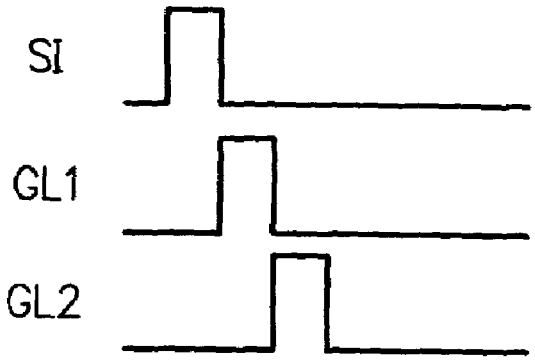
FIG. 5B is a timing chart showing the operation of the scanning driver.

FIG. 5B is a timing chart for explaining the operation of the scanning driver 4*a* shown in FIG. 5A. The scanning driver 4*a* functions like a shift register. More specifically, when a start signal pulse is input to the start signal terminal SI, the scanning driver 4*a* sequentially outputs pulses to the first output line GL1, the second output line GL2, . . . , the n-th output line GLn.

Figure 6:
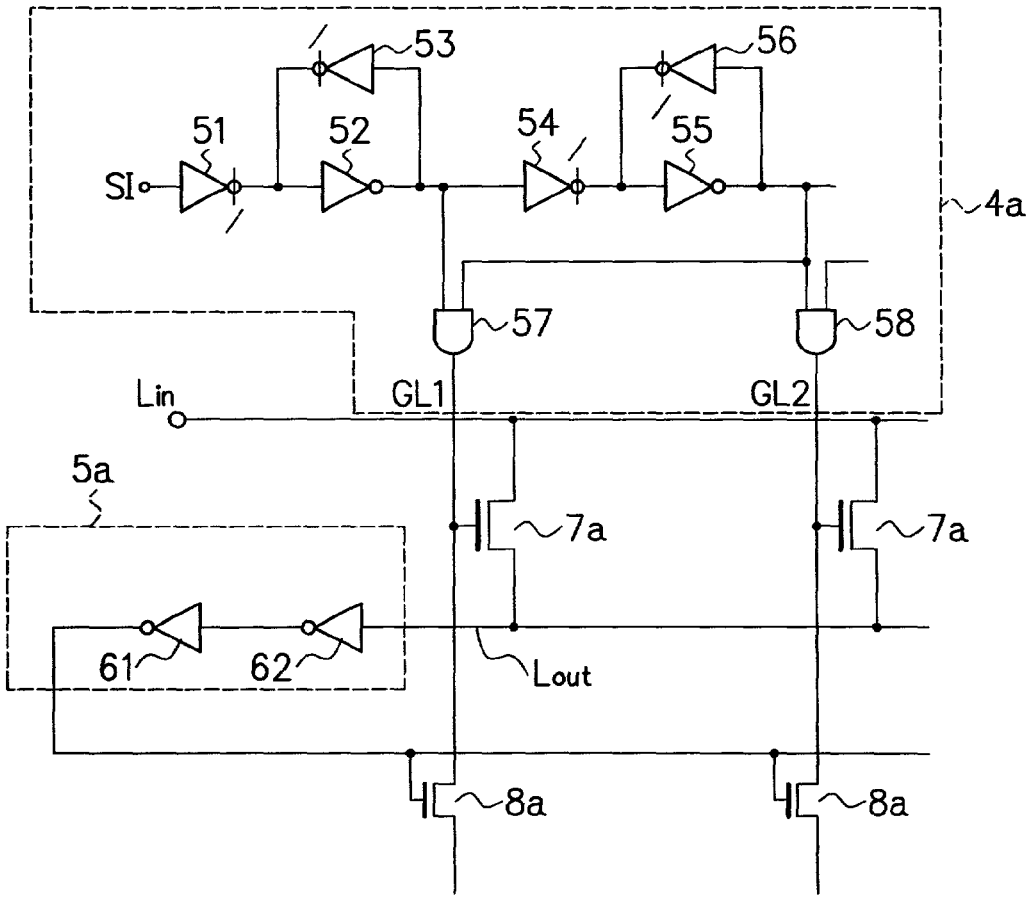
FIG. 6 is a circuit diagram of a judging unit according to the first embodiment and its peripheral portion.

FIG. 6 is a circuit diagram of the judging unit 5*a* shown in FIG. 1 and its peripheral portion. The scanning driver 4*a* has the same structure as that of the scanning driver 4*a* shown in FIG. 5A. The n-channel MOS transistors 7*a* correspond to the transistors 7*a* shown in FIG. 1. The n-channel MOS transistors 8*a* correspond to the transistors 8*a* shown in FIG. 1. The judging unit 5*a* corresponds to the judging unit 5*a* shown in FIG. 1, which is constructed by connecting two inverters 61 and 62 in series and has a function of shaping a signal received from a line Lout to H/L. The judging unit 5*b* and its peripheral portion have the same arrangement as that of the judging unit 5*a* and its peripheral portion.

Figure 7:
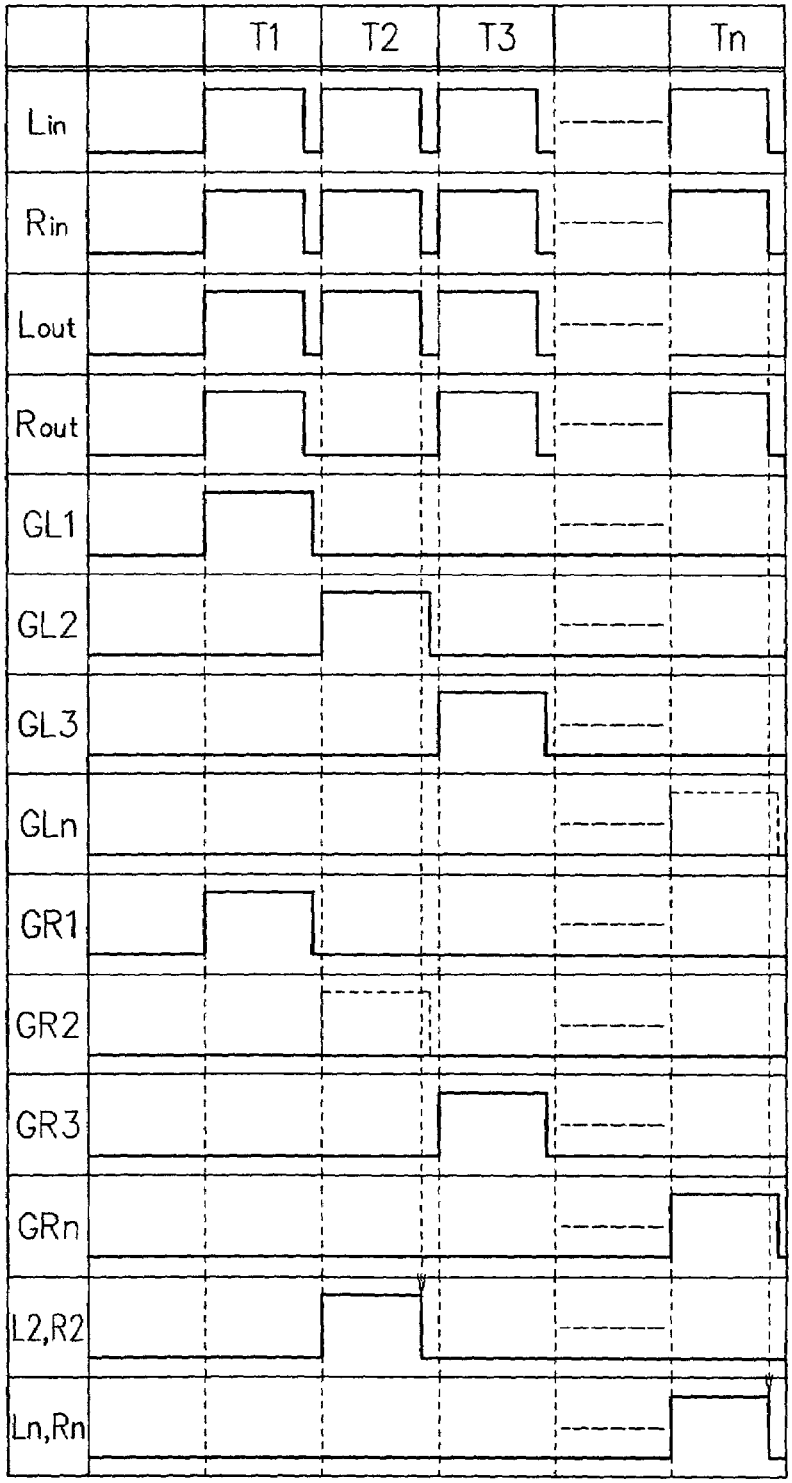
FIG. 7 is a timing chart showing the operation of the liquid crystal display device according to the first embodiment.

FIG. 7 is a timing chart showing the operation of the liquid crystal display device (FIG. 1) according to the first embodiment. A case wherein the defects are present at the short-circuit points 10 and 11 and disconnection point 12, as shown in FIG. 1, will be exemplified.

Pulsed check signals are supplied to the check input terminals Lin and Rin. Normal pulses are sequentially output to the output lines GL1 to GLn−1. That is, a pulse is generated in the first output line GL1 at a timing T1, a pulse is generated to the second output line GL2 at a timing T2, and a pulse is generated to the third output line GL3 at a timing T3.

The n-th output line GLn is fixed at low level because it short-circuits to the ground line at the short-circuit point 10, and no pulse is output at a timing Tn when a pulse should be output.

Similarly, normal pulses are sequentially output to the output lines GR1 and GR3 to GRn. That is, a pulse is generated in the first output line GR1 at the timing T1, a pulse is generated in the third output line GR3 at the timing T3, and a pulse is generated in the n-th output line GRn at the timing Tn.

The second output line GR2 is fixed at low level because it short-circuits to the ground line at the short-circuit point 11, and no pulse is output at the timing T2 when a pulse should be output.

The signal from the check input terminal Lin is transmitted to the output line Lout (FIG. 6) to the judging unit 5*a* through the transistors 7*a*. Since the output lines GL1 to GLn−1 are normal, the signal from the check input terminal Lin directly appears on the output line Lout at the timings T1 to Tn−1. However, since the output line GLn is fixed at low level, the transistor 7*a* is turned off to change the output line Lout to low level at the timing Tn.

In a similar manner, the signal from the check input terminal Rin is transmitted to an output line Rout to the judging unit 5*b* through the transistors 7*b*. Since the output lines GR1 and GR3 to GRn are normal, the signal from the check input terminal Rin directly appears on the output line Rout at the timings T1 and T3 to Tn. However, since the output line GR2 is fixed at low level, the transistor 7*b* is turned off to change the output line Rout to low level at the timing T2.

As a result, at the timing T2, the output line GR2 is disconnected, and a scanning signal is supplied from the output line GL2 of the first scanning driver 4*a* so that a pulse appears on the second scanning line (L2,G2). In addition, at the timing Tn, the output line GLn is disconnected, and a scanning signal is supplied from the output line GRn of the second scanning driver 4*b* so that a pulse appears on the nth scanning line (Ln,Gn). In the above way, the defective points 10 to 12 are automatically corrected, and all lines are normally displayed.

The reason why the signal at the check input terminal Lin is not fixed at high level and is formed from pulses having a short low-level period at each timing will be described. For example, at the timing T1, the signal at the check input terminal Lin is changed to low level during the high-level period immediately before the selection period of the output line GL1 connected to the gate of the transistor 7*a* is ended. At this time, the transistor 7*a* is turned on, and the signal of the input terminal Lin is transmitted to the output line Lout to the judging unit 5*a* to reset the output line Lout to low level. With this operation, unnecessary charges can be removed from the output line Lout of the judging unit 5*a* to cancel the previous state. If the signal of the input terminal Lin is fixed at high level, the output line Lout is not reset and becomes unstable. That is, unless the transistors 8*a* are temporarily turned off, the output lines GR1 to GRn affect on determination for the output lines GL1 to GLn, and which scanning driver 4*a* or 4*b* is being determined is unclear. To prevent this, the signals of the input terminals Lin and Rin must be pulsed.

(Second Embodiment)

Figure 8:
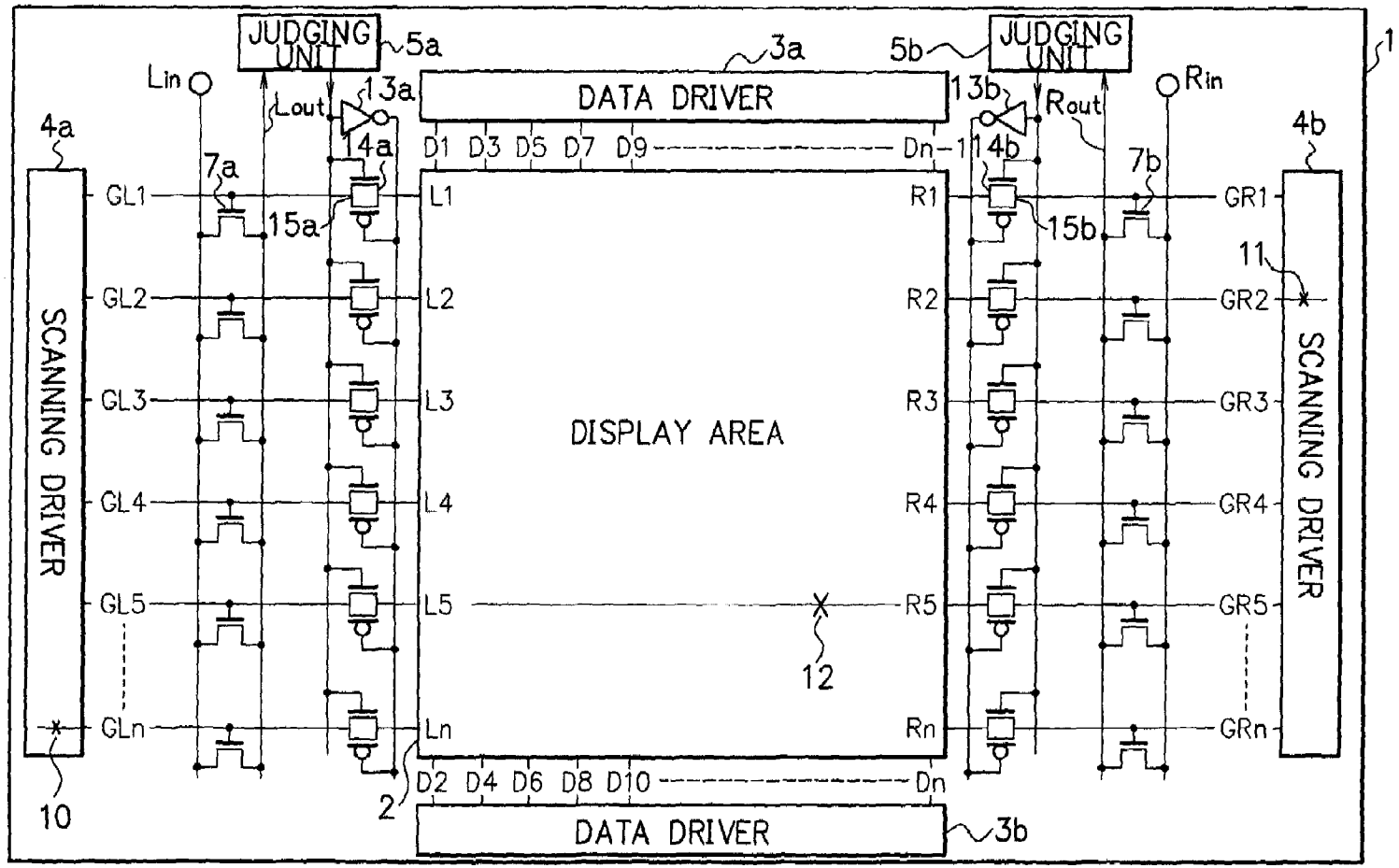
FIG. 8 is a block diagram showing the structure of a liquid crystal display device according to the second embodiment of the present invention.

FIG. 8 is a block diagram showing the structure of a liquid crystal display device according to the second embodiment of the present invention. The second embodiment is different from the first embodiment only in that n-channel MOS transistors 14*a* and 14*b*, p-channel MOS transistors 15*a* and 15*b*, and inverters 13*a* and 13*b* are provided in place of the switching transistors 8*a* and 8*b* in the first embodiment.

The portion on a first scanning driver 4*a* side will be described first. A CMOS (Complementary MOS) transistor made up from an n-channel MOS transistor 14*a* and a p-channel MOS transistor 15*b* forms a switch. One of the source and drain of each of the transistors 14*a* and 15*a* is connected to output lines GL1 to GLn of the first scanning driver 4*a*, and the other is connected to scanning lines L1 to Ln in a display area 2. The gates of n-channel MOS transistors 14*a* are connected to the output of a judging unit 5*a*. A signal obtained by logically inverting the output from the judging unit 5*a* is input to the gates of p-channel MOS transistors 15*a*. The CMOS transistors (14*a*, 15*a*) function as switching units for connecting/disconnecting the output lines GL1 to GLn and scanning lines L1 to Ln.

In the portion on a second scanning driver 4*b* side as well, one of the source and drain of each of the n-channel MOS transistor 14*b* and the p-channel MOS transistor 15*b* is connected to output lines GR1 to CRn of the second scanning driver 4*b*, and the other is connected to scanning lines R1 to Rn in the display area 2. The gates of n-channel MOS transistors 14*b* are connected to the output of a judging unit 5*b*. A signal obtained by logically inverting the output from the judging unit 5*b* is input to the gates of p-channel MOS transistors 15*b*. The CMOS transistors (14*b*, 15*b*) function as switching units for connecting/disconnecting the output lines GR1 to GRn and scanning lines R1 to Rn.

In the second embodiment, by forming the switching units from the CMOS transistors (14*a*, 15*a*) and (14*b*, 15*b*), the switching speed can be increased as compared to the first embodiment that uses the n-channel MOS transistors 8*a* and 8*b*. When the switching speed is increased, a scanning signal can be reliably supplied to the display area 2 at a predetermined timing, and the operation can be stabilized.

(Third Embodiment)

Figure 9:
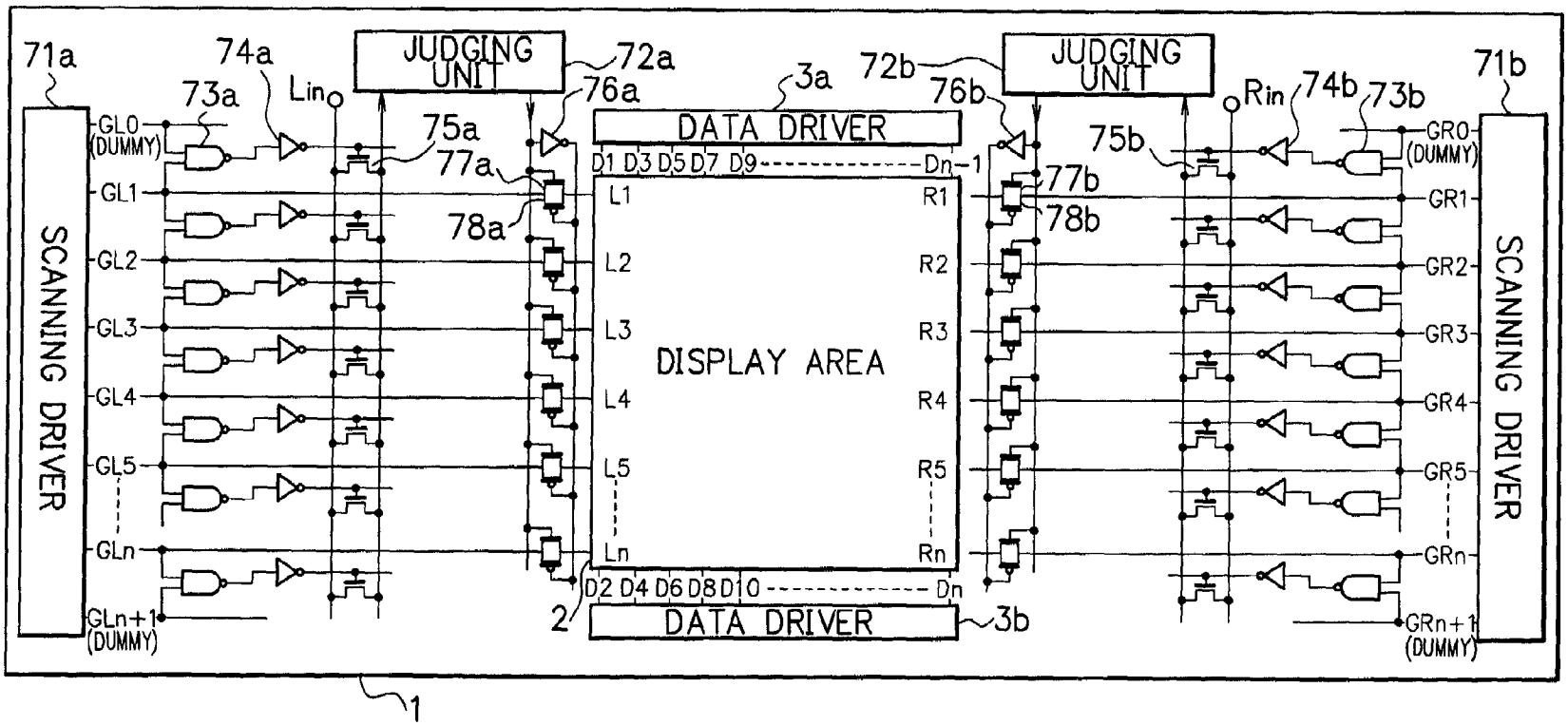
FIG. 9 is a block diagram showing the structure of a liquid crystal display device according to the third embodiment of the present invention.

FIG. 9 is a block diagram showing the structure of a liquid crystal display device according to the third embodiment of the present invention. In the third embodiment, the output lines in first and second scanning drivers 71*a* and 71*b* are short-circuited to power supply line, so when a defect to fix an output line at high level is generated, the defect can be detected and automatically corrected.

In addition to a display area 2, a first data driver 3*a*, a second data driver 3*b*, a first scanning driver 71*a*, and a second scanning driver 71*b*, judging units 72*a* and 72*b*, NAND circuits 73*a* and 73*b*, inverters 74*a*, 74*b*, 76*a*, and 76*b*, n-channel MOS transistors 75*a*, 75*b*, 77*a*, and 77*b*, and p-channel MOS transistors 78*a* and 78*b* are integrally formed on a glass substrate 1.

The display area 2 and the first and second data drivers 3*a* and 3*b* are the same as in the first embodiment (FIG. 1). The first scanning driver 71*a* additionally has a 0th output line GL0 and (n+1)th output line GLn+1 as dummy lines, unlike the first scanning driver 4*a* of the first embodiment (FIG. 1). The output lines GL0 and GLn+1 are not connected to the display area 2 but used to detect whether the output lines GL0 to GLn+1 of the first scanning driver 71*a* short-circuit to the power supply line. The second scanning driver 71*b* also additionally has a 0th output line GR0 and (n+1)th output line GRn+1 as dummy lines, unlike the second scanning driver 4*b* of the first embodiment (FIG. 1).

The inverters 76*a* and 76*b*, the n-channel MOS transistors 77*a* and 77*b*, and the p-channel MOS transistors 78*a* and 78*b* correspond to the inverters 13*a* and 13*b*, the n-channel MOS transistors 14*a* and 14*b*, and the p-channel MOS transistors 15*a* and 15*b* in the second embodiment (FIG. 8).

More specifically, the sources and drains of the MOS transistors 77*a* and 78*a* are connected to the output lines GL1 to GLn of the first scanning driver 71*a* and scanning lines L1 to Ln in the display area 2, respectively. The gates of the n-channel MOS transistors 77*a* are connected to the output of the judging unit 72*a*. The gates of the p-channel MOS transistors 78*a* are connected to the output of the judging unit 72*a* through the inverter 76*a*.

The sources and drains of the MOS transistors 77*b* and 78*b* are connected to the output lines GR1 to GRn of the second scanning driver 71*b* and scanning lines R1 to Rn in the display area 2, respectively. The gates of the n-channel MOS transistors 77*b* are connected to the output of the judging unit 72*b*. The gates of the p-channel MOS transistors 78*b* are connected to the output of the judging unit 72*b* through the inverter 76*b*.

Each NAND circuit 73*a* has its input connected to two neighboring ones of the output lines GL0 to GLn+1 of the first scanning driver 71*a* and outputs the NAND result of scanning signals on the two output lines. Each inverter 74*a* receives the output from the corresponding NAND circuit 73*a* and outputs a logically inverted signal.

The check n-channel MOS transistors 75*a* correspond to the check transistors 7*a* in the first embodiment (FIG. 1). The gate of each check transistor 75*a* is connected to the output of the corresponding inverter 74*a*. One of the source and drain of each check transistor 75*a* is connected to a check input terminal Lin, and the other is connected to the input terminal of the judging unit 72*a*.

A check signal is input to the check input terminal Lin. When one of the output lines GL0 to GLn+1 is selected, the transistors 75*a* are turned on/off in accordance with the selection state. When a transistor 75*a* is turned on, the check signal input from the check input terminal Lin is output to the judging unit 72*a*.

The judging unit 72*a* determines in accordance with the input of the check signal whether one or more output lines of the output lines GL0 to GLn+1 of the first scanning driver 71*a* are short-circuited to the power supply line and fixed at high level, and if so, outputs a low-level signal. Otherwise, the judging unit 72*a* outputs a high-level signal.

When the judging unit 72*a* outputs a high-level signal, the transistors 77*a* and 78*a* are turned on to connect the output lines GL1 to GLn of the first scanning driver 71*a* to the scanning lines L1 to Ln in the display area 2. Thus, the display area 2 can receive scanning signals from the first scanning driver 71*a* and be normally displayed.

On the other hand, when the judging unit 72*a* outputs a low-level signal, the transistors 77*a* and 78*a* corresponding to the abnormal output line are turned off to disconnect the abnormal output line of the output lines GL1 to GLn of the first scanning driver 71*a* from the corresponding one of the scanning lines L1 to Ln in the display area 2. This prevents the abnormal scanning signal from being supplied to the display area 2.

The first scanning driver 71*a*, the NAND circuits 73*a*, the inverters 74*a* and 76*a*, the transistors 75*a*, 77*a*, and 78*a*, and the first judging unit 72*a* have been described above. This also applies to the second scanning driver 71*b*, the NAND circuits 73*b*, the inverters 74*b* and 76*b*, the transistors 75*b*, 77*b*, and 78*b*, and the second judging unit 72*b*.

Figure 10:
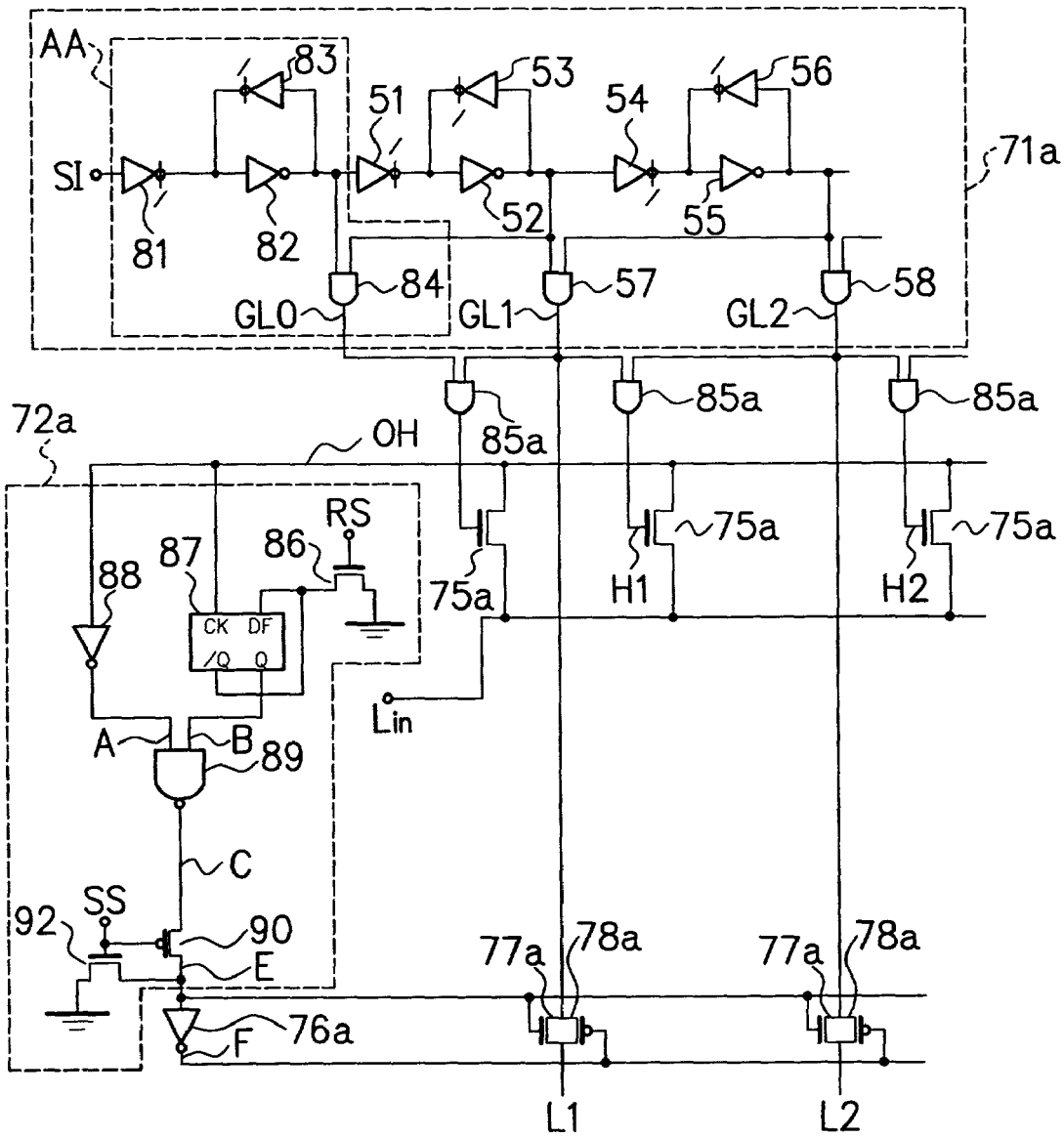
FIG. 10 is a circuit diagram of a judging unit according to the third embodiment and its peripheral portion.

FIG. 10 is a circuit diagram of the judging unit 72*a* shown in FIG. 9 and its peripheral portion. The judging unit 72*a* and its peripheral circuits will described below. This also applies to the judging unit 72*b* and its peripheral circuits. The scanning driver 71*a* additionally has a unit circuit AA for outputting the dummy output line GL0 and a unit circuit for outputting the dummy output line GLn+1, unlike the scanning driver 4*a* shown in FIG. 5A. The unit circuit AA has clocked inverters 81 and 83, an inverter 82, and an AND circuit 84, which correspond to the clocked inverters 54 and 56, the inverter 55, and the AND circuit 58 as an odd-numbered unit. For each of the clocked inverters 81, 53, and 54, referring to FIG. 4B, a clock bar signal terminal /CLK is connected to the gate of a transistor 41, and a clock signal terminal CLK is connected to the gate of a transistor 44. For each of the clocked inverters 83, 51, and 56, referring to FIG. 4B, the clock bar signal terminal /CLK is connected to the gate of the transistor 44, and the clock signal terminal CLK is connected to the gate of the transistor 41.

AND circuits 85*a* correspond to the combinations of the NAND circuits 73*a* and the inverters 74*a* in FIG. 9. The n-channel MOS transistors 75*a* and 77*a*, the p-channel MOS transistors 78*a*, and the inverter 76*a* correspond to the elements having the same reference numerals in FIG. 9.

The judging unit 72*a* has a D flip-flop 87, an inverter 88, a NAND circuit 89, a p-channel MOS transistor 90, and n-channel MOS transistors 86 and 92. The D flip-flop 87 has a clock terminal CK connected to the sources of the n-channel MOS transistors 75*a* through a signal line OH and an input terminal DF connected to an inverting output terminal /Q of its own. The n-channel MOS transistor 86 has its gate connected to a reset terminal RS, its drain connected to the input terminal DF, and its source connected to the ground terminal.

The inverter 88 has its input connected to the signal line OH and outputs the logically inverted signal of the input signal. The NAND circuit 89 has one input signal line A connected to the output of the inverter 88 and the other input signal line B connected to an output terminal Q of the D flip-flop 87. The p-channel MOS transistor 90 has its gate connected to a terminal SS, its source connected to the output of the NAND circuit 89, and its drain connected to the input of the inverter 76*a*. The n-channel MOS transistor 92 has its gate connected to the terminal SS, its drain connected to the input of the inverter 76*a*, and its source connected to the ground terminal.

Figure 11:
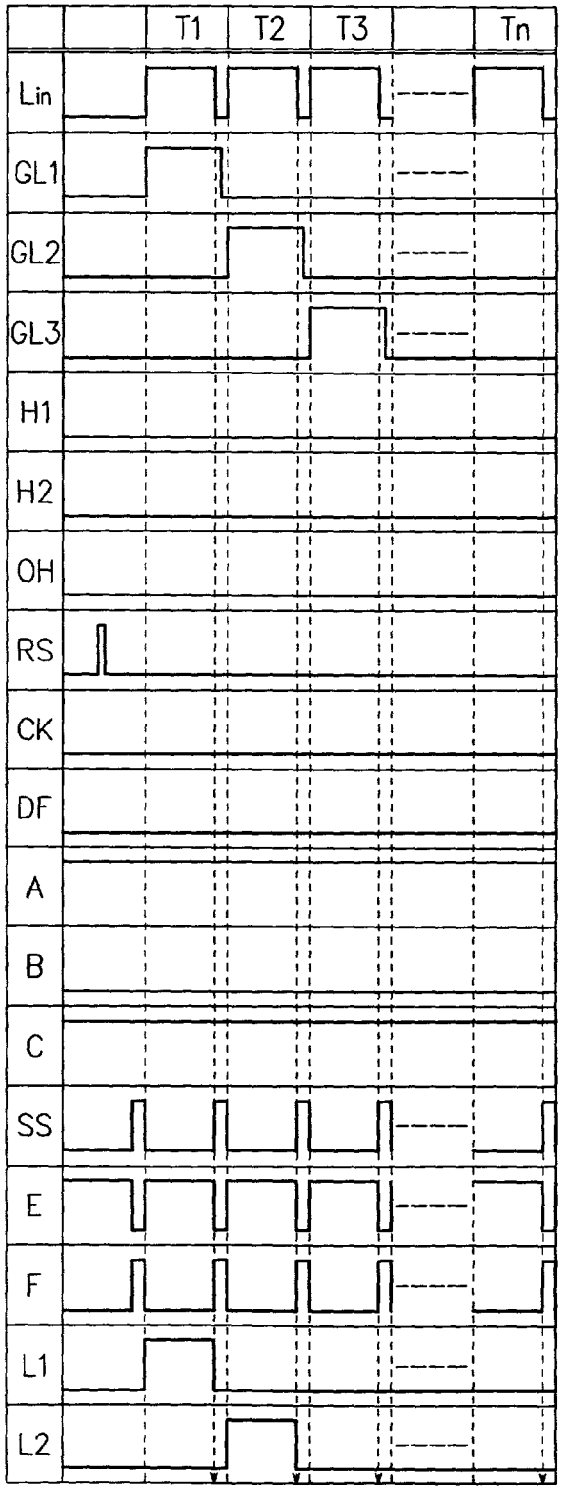
FIG. 11 is a timing chart showing operation when the liquid crystal display device according to the third embodiment is normal.
Figure 12:
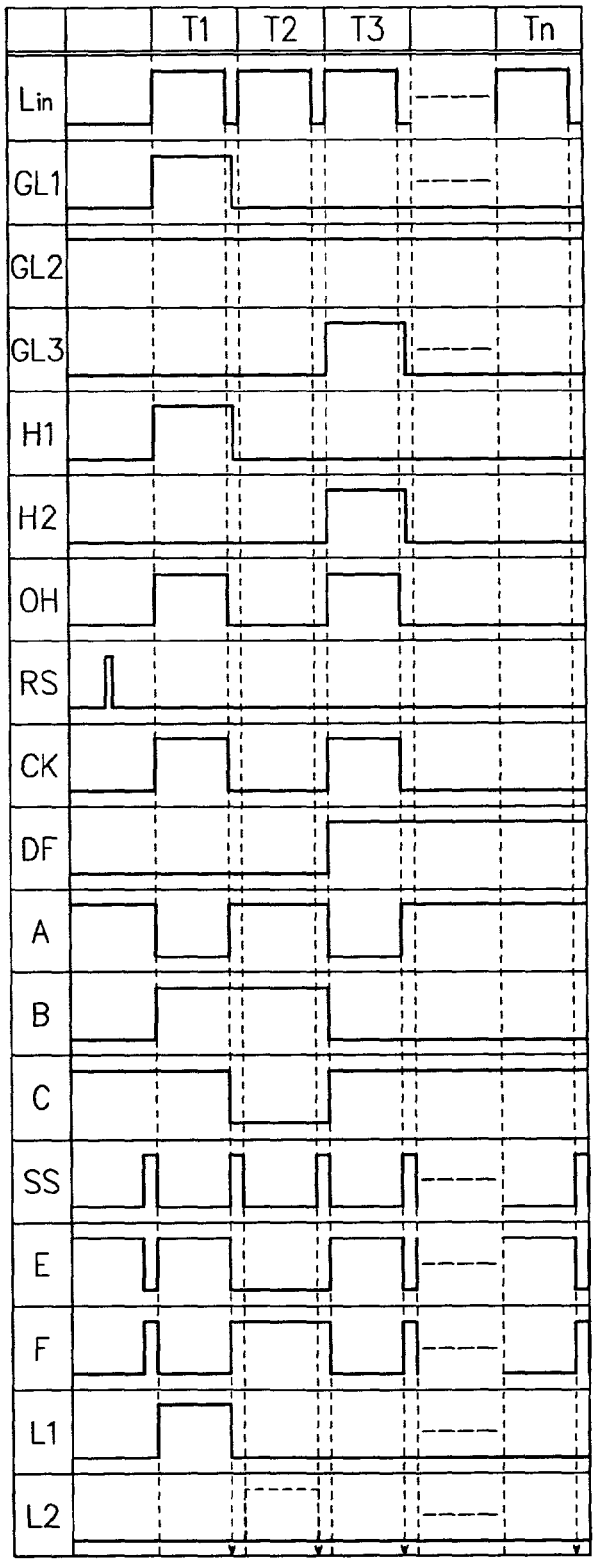
FIG. 12 is a timing chart showing operation when a scanning line in a scanning driver of the liquid crystal display device according to the third embodiment is fixed at high level.

FIG. 11 is a timing chart showing the operation of the liquid crystal display device according to the third embodiment. This will be described by exemplifying a liquid crystal display device having no defect. FIGS. 11 and 12 show the timing on the first scanning driver 71*a* side. The timing on the second scanning driver 71*b* side is the same as in FIGS. 11 and 12.

Pulsed check signals are supplied to the check input terminals Lin and Rin, as in the first embodiment (FIG. 7). Normal pulsed scanning signals are sequentially output to the output lines GL0 to GLn+1 and GR0 to GRn+1.

The signal on a signal line H1 (FIG. 10) is the AND result of the signals on the output lines GL1 and GL2 and therefore holds low level. The signal on a signal line H2 (FIG. 10) is the AND result of the signals on the output lines GL2 and GL3 and therefore holds low level. When the signal lines H1, H2, and the like hold low level, all the n-channel MOS transistors 75*a* are turned off, so the signal line OH holds low level.

A pulsed reset signal is supplied to the reset terminal RS before the start timing of the scanning signal. The clock terminal CK of the D flip-flop 87 is connected to the signal line OH and holds low level, like the signal line OH. When the reset signal is input to the reset terminal RS, the input terminal DF of the D flip-flop 87 holds low level.

The input signal line A has a signal inverted from that on the signal line OH and holds high level. The input signal line B is connected to the output terminal Q of the D flip-flop 87 and holds low level. A signal line C has the NAND signal level of the signals on the signal lines A and B and therefore holds high level.

A pulse signal is supplied to the terminal SS. An input line E of the inverter 76*a* goes low when the terminal SS has a high-level signal, and has the same signal level as that on the signal line C when the terminal SS has a low-level signal. An output line F of the inverter 76*a* has a signal level inverted from that on the input line E.

The scanning line L1 has the same signal level as that on the output line GL1 when the signal line E is at high level (i.e., when the signal line F is at low level), and goes low when the signal line E is at low level. Similarly, the scanning line L2 has the same signal level as that on the output line GL2 when the signal line E is at high level, and goes low when the signal line E is at low level.

Consequently, the scanning signals on the output lines GL1 to GLn are sequentially normally supplied to the scanning lines L1 to Ln as pulses. Similarly, the scanning signals on the output lines GR1 to GRn are sequentially normally supplied to the scanning lines R1 to Rn as pulses.

FIG. 12 is a timing chart showing operation when the output line GL2 of the scanning driver 71*a* is short-circuited to the power supply line and fixed at high level in the liquid crystal display device according to the third embodiment.

Pulsed check signals are supplied to the check input terminals Lin and Rin. Only the output line GL2 is fixed at high level, and the remaining output lines GL0, GL1, and GL3 to GLn+1 sequentially output normal pulsed scanning signals.

Since the signal on the signal line H1 is the AND result of the signals on the output lines GL1 and GL2, a pulse is output at a timing T1. Since the signal on the signal line H2 is the AND result of the signals on the output lines GL2 and GL3, a pulse is output at a timing T3.

The signal line OH has the same signal level as that of the signal of the check input terminal Lin when the signal on the signal line H1 or H2 goes high, and otherwise, goes low. As a result, the signal line OH outputs a pulse only at the timings T1 and T3, and holds low level during the remaining period. The signals at the terminals RS and SS are the same as in FIG. 11.

The clock terminal CK of the D flip-flop 87 has the same signal level as that on the signal line OH. The input terminal DF of the D flip-flop 87 changes from low level to high level at the timing T3 in accordance with the second leading edge of the signal at the clock terminal CK.

A signal inverted from that on the signal line OH is supplied to the input signal line A. The signal level on the input signal line B is inverted in accordance with the leading edge at the clock terminal CK of the D flip-flop 87. That is, the signal level changes from low level to high level at the timing T1 and from high level to low level at the timing T3. The signal line C has the NAND signal level of the signals on the signal lines A and B.

The input line E of the inverter 76*a* goes low when the signal at the terminal SS is at high level, and has the same signal level as that on the signal line C when the signal at the terminal SS is at low level. The output line F of the inverter 76*a* has a signal level inverted from that on the input line E.

The scanning line L1 has the same signal level as that on the output line GL1 when the signal line E is at high level, and goes low when the signal line E is at low level. Similarly, the scanning line L2 has the same signal level as that on the output line GL2 when the signal line E is at high level, and goes low when the signal line E is at low level.

As a result, the scanning line L1 outputs a pulse at the timing T1, as in FIG. 12. However, for the scanning line L2, since the output line GL2 is short-circuited to the power supply line, no pulse is output at a timing T2 when a pulse should be output. Instead, at the timing T2, a normal scanning signal is supplied from the output line GR2 of the second scanning driver 71*b* to the scanning line R2 in the display area 2, so normal display is performed.

(Fourth Embodiment)

A liquid crystal display device according to the fourth embodiment of the present invention is different from the third embodiment (FIG. 9) only in the structure of judging units 72*a* and 72*b*. According to the fourth embodiment, when a defect is generated, with which two or more neighboring (continuous) output lines of a first or second scanning driver 71*a* or 71*b* are short-circuited to the power supply line and fixed at high level, the defect can be detected and automatically corrected. When two or more neighboring output lines of the first scanning driver 71*a* short-circuit to the power supply line, all output lines of the first scanning driver 71*a* are disconnected from a display area 2, and scanning signals are supplied from the output lines of the second scanning driver 71*b* to the display area 2. On the other hand, when two or more neighboring output lines of the second scanning driver 71*b* short-circuit to the power supply line, all output lines of the second scanning driver 71*b* are disconnected from the display area 2, and scanning signals are supplied from the output lines of the first scanning driver 71*a* to the display area 2.

Figure 13:
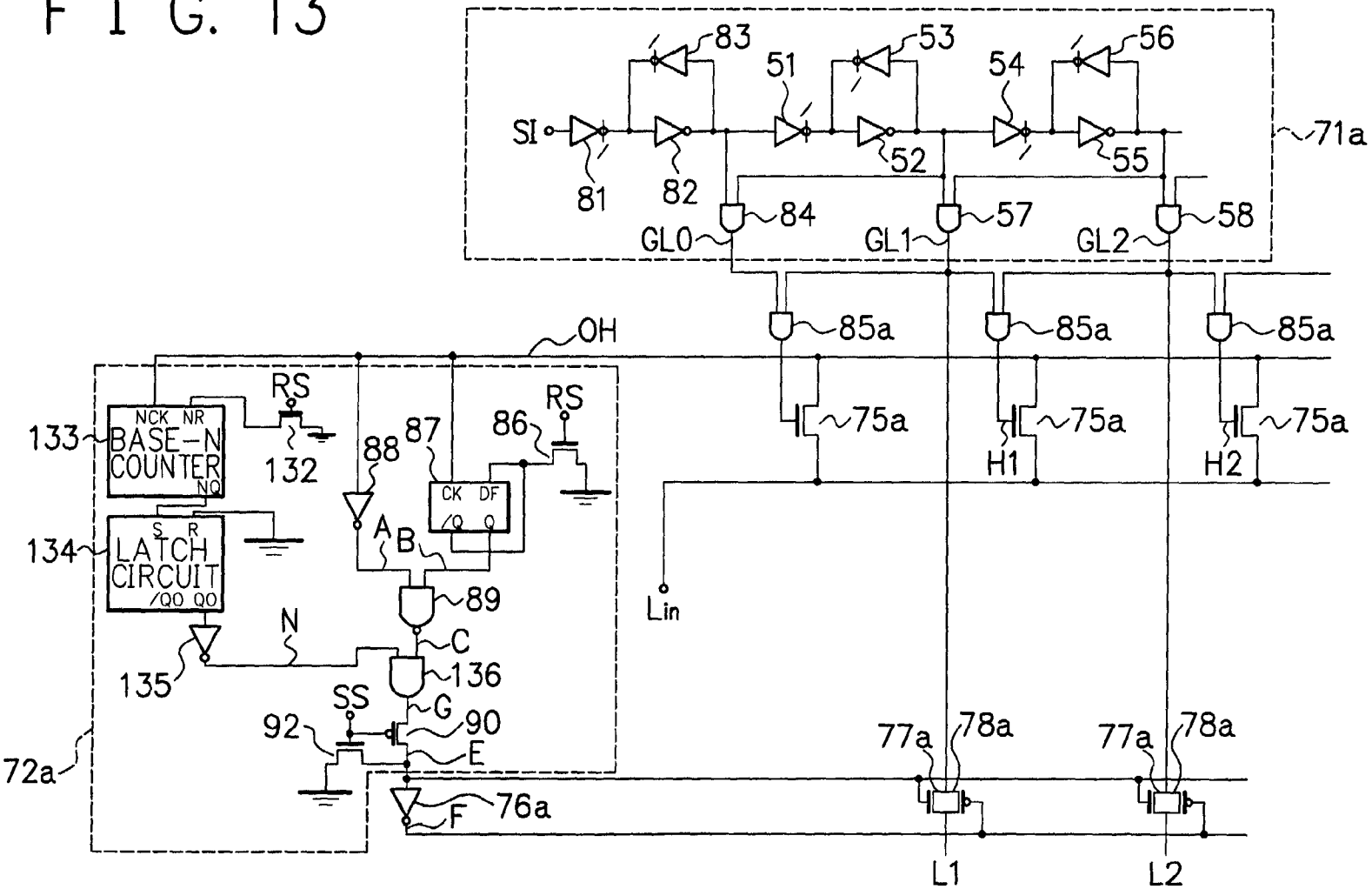
FIG. 13 is a circuit diagram of a judging unit and its peripheral portion in a liquid crystal display device according to the fourth embodiment of the present invention.

FIG. 13 is a circuit diagram of the judging unit 72*a* according to the fourth embodiment and its peripheral portion. The judging unit 72*a* and its peripheral circuits will be described below. This also applies to the judging unit 72*b* and its peripheral portion. The judging unit 72*a* additionally has a base-n counter 133, an n-channel MOS transistor 132, a latch circuit 134, an inverter 135, and an AND circuit 136.

The base-n counter 133 has its input terminal NCK connected to a signal line OH and its reset terminal NR connected to the drain of the n-channel MOS transistor 132. The base-n counter 133 counts N pulses and then outputs a high-level signal from an output terminal NQ. The n-channel MOS transistor 132 has its source connected to the ground terminal and its gate connected to a reset terminal RS.

For example, when the horizontal resolution in the display area of the liquid crystal display device is 600; N=600. The base-n counter 133 counts N pulses in one frame and then outputs a high-level signal from the output terminal NQ. When the number of pulses in one frame is smaller than N, the base-n counter 133 resets the count value at every frame and outputs a low-level signal from the output terminal NQ.

The latch circuit 134 has its set terminal S connected to the output terminal NQ of the base-n counter 133 and its reset terminal R connected to the ground terminal. When a high-level signal is input to the set terminal S, the latch circuit 134 outputs a high-level signal from an output terminal Q0. The inverter 135 has its input terminal connected to the output terminal Q0 of the latch circuit 134 and outputs an output signal inverted from the input signal to a signal line N.

The output terminal of a NAND circuit 89 is connected to a signal line C, like the NAND circuit 89 (FIG. 10) in the judging unit 72*a* of the third embodiment. The AND circuit 136 having its input terminals connected to the signal lines C and N performs an AND operation between the signals of these signal lines and outputs an output signal to a signal line G. A p-channel MOS transistor 90 has its source connected to the signal line G, its drain connected to a signal line E, and its gate connected to a terminal SS. An n-channel MOS transistor 92 has its source connected to the ground terminal, its drain connected to the signal line E, and its gate connected to the terminal SS. An inverter 76*a* has its input terminal connected to the signal line E and outputs an output signal inverted from the input signal to a signal line F. The signal line E is connected to the gates of n-channel MOS transistors 77*a*. The signal line F is connected to the gates of p-channel MOS transistors 78*a*.

Figure 14:
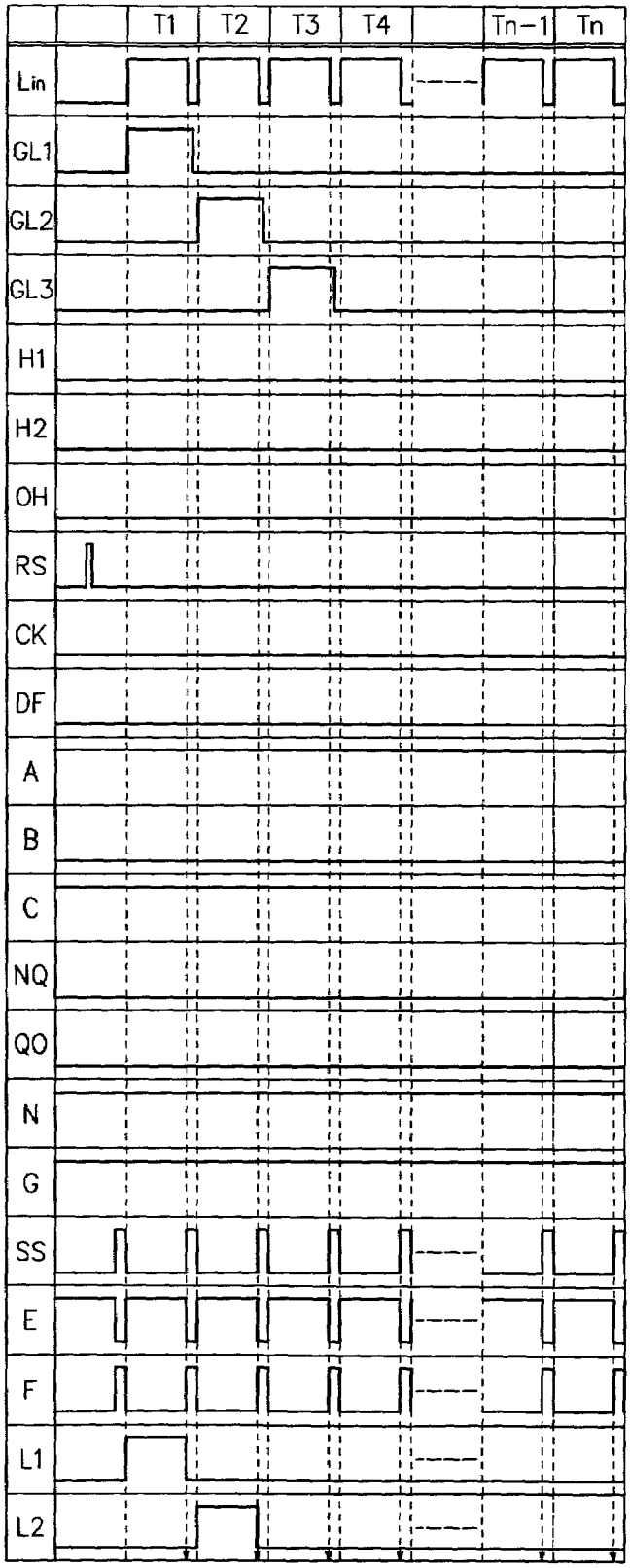
FIG. 14 is a timing chart showing operation when the liquid crystal display device according to the fourth embodiment is normal.
Figure 15:
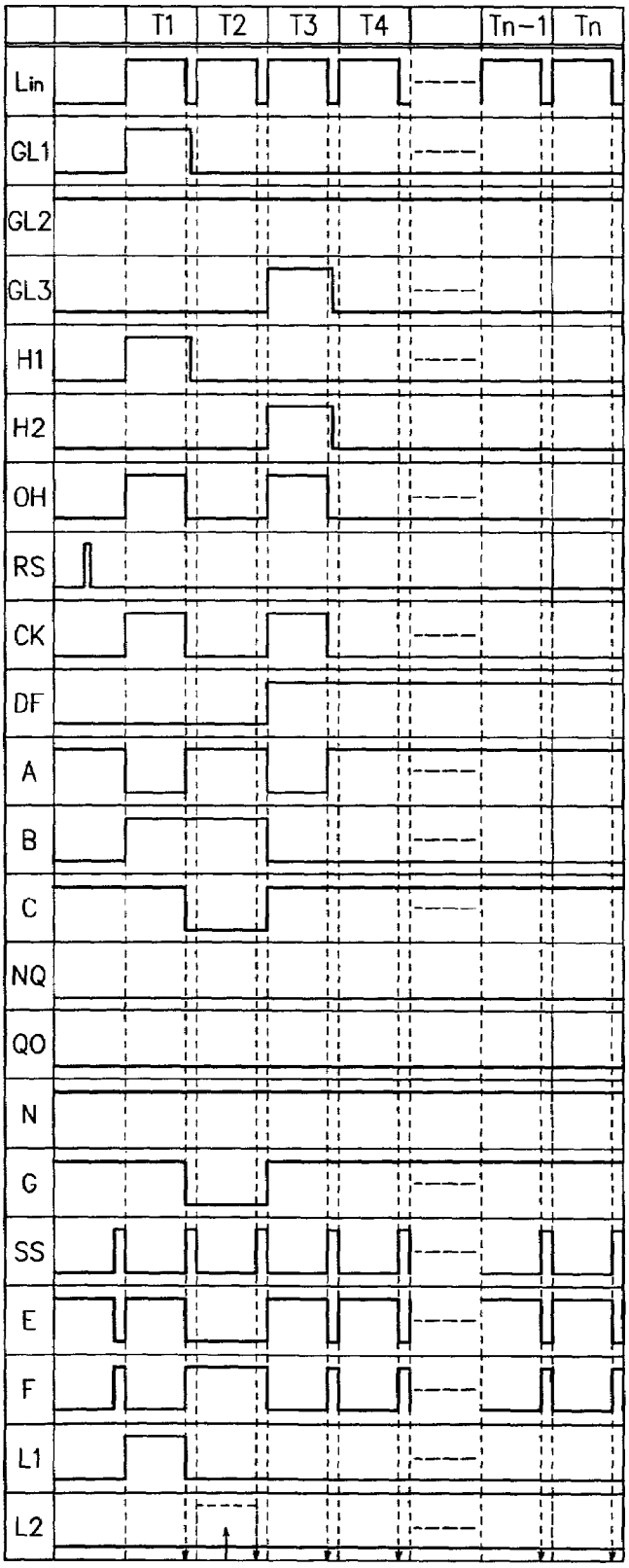
FIG. 15 is a timing chart showing operation when a scanning line in a scanning driver of the liquid crystal display device according to the fourth embodiment is fixed at high level.
Figure 16:
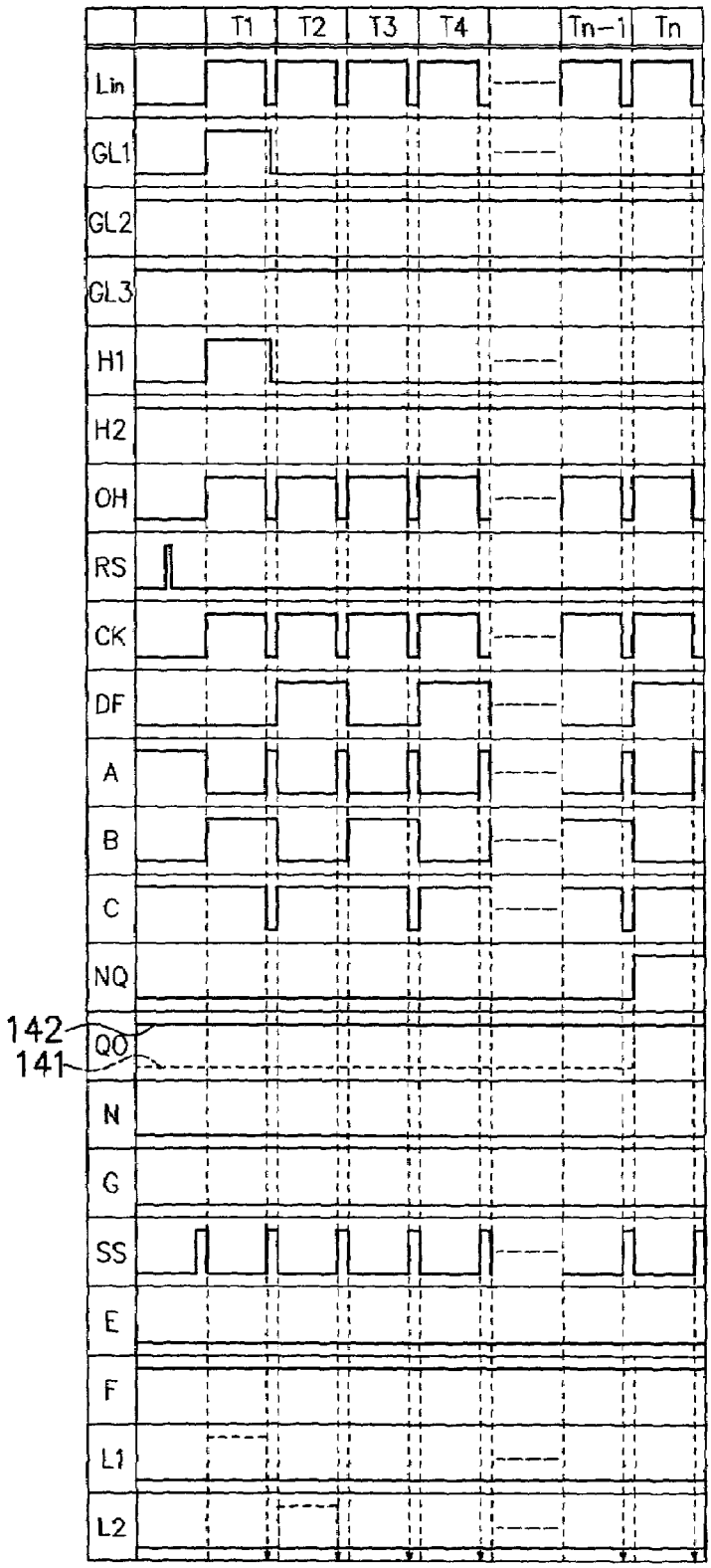
FIG. 16 is a timing chart showing operation when two scanning lines adjacent to each other in the scanning driver of the liquid crystal display device according to the fourth embodiment are fixed at high level.

FIG. 14 is a timing chart showing the operation of the liquid crystal display device according to the fourth embodiment. This will be described by exemplifying a liquid crystal display device having no defect. FIGS. 14 to 16 show the timing on the first scanning driver 71*a* side. The timing on the second scanning driver 71*b* side is the same as in FIGS. 14 to 16.

A pulsed check signal is supplied to a check input terminal Lin, as in the third embodiment (FIG. 11). Output lines GL0 to GLn+1 sequentially output normal pulsed scanning signals.

A signal line H1 has the AND signal level of the signals on the output lines GL1 and GL2 and therefore holds low level. A signal line H2 has the AND signal level of the signals on the output lines GL2 and GL3 and therefore holds low level. All transistors 75*a* are then turned off, and the signal line OH also holds low level.

The same signals as in the third embodiment (FIG. 11) are input to the reset terminal RS and terminal SS. A clock terminal CK of a D flip-flop 87 has the same signal level as on the signal line OH and holds low level. When a reset signal is input to the reset terminal RS, an input terminal DF of the D flip-flop 87 holds low level.

An input line A has a signal inverted from that on the signal line OH and holds high level. An input line B is connected to an output terminal Q of the D flip-flop 87 and holds low level. The signal line C has the NAND signal level of the signals on the signal lines A and B and therefore holds high level.

Since the signal line OH connected to the input terminal NCK of the base-n counter 133 holds low level, the output terminal NQ also holds low level. Since the output terminal NQ connected to the set terminal S of the latch circuit 134 holds low level, the output terminal Q0 of the latch circuit 134 also holds low level. The signal line N has a signal level inverted from that on the output terminal Q0 and therefore holds high level.

The signal line G has the AND signal level of the signals on the signal lines N and C and holds high level. The input line E of the inverter 76*a* goes low when the terminal SS has a high-level signal, and has the same signal level as that on the signal line G when the terminal SS has a low-level signal. The output line F of the inverter 76*a* has a signal level inverted from that on the input line E.

The scanning line L1 has the same signal level as that on the output line GL1 when the signal line E is at high level, and goes low when the signal line E is at low level. Hence, a pulse is output at a timing T1. Similarly, the scanning line L2 has the same signal level as that on the output line GL2 when the signal line E is at high level, and goes low when the signal line E is at low level. Hence, a pulse is output at a timing T2.

Consequently, the scanning signals on the output lines GL1 to GLn are normally supplied to the scanning lines L1 to Ln. Similarly, the scanning signals on the output lines GR1 to GRn are normally supplied to the scanning lines R1 to Rn.

FIG. 15 is a timing chart showing operation when the output line GL2 of the scanning driver 71*a* is short-circuited to the power supply line and fixed at high level in the liquid crystal display device according to the fourth embodiment.

A pulsed check signal is supplied to the check input terminal Lin. Only the output line GL2 is fixed at high level, and the remaining output lines GL0, GL1, and GL3 to GLn+1 sequentially output normal pulsed scanning signals.

Since the signal line H1 has the AND signal level of the signals on the output lines GL1 and GL2, a pulse is output at the timing T1. Since the signal line H2 has the AND signal level of the signals on the output lines GL2 and GL3, a pulse is output at a timing T3.

The signal line OH has the same signal level as that of the signal of the check input terminal Lin when the signal on the signal line H1 or H2 goes high, and otherwise, goes low. As a result, the signal line OH outputs a pulse only at the timings T1 and T3, and holds low level during the remaining period. The signals at the terminals RS and SS are the same as in FIG. 14.

The clock terminal CK of the D flip-flop 87 has the same signal level as that on the signal line OH. The input terminal DF of the D flip-flop 87 changes from low level to high level at the timing T3 in accordance with the second leading edge of the signal at the clock terminal CK.

The input line A has a signal level inverted from that on the signal line OH. The signal level on the input line B is inverted in accordance with the leading edge of the signal at the clock terminal CK of the D flip-flop 87. That is, the signal level changes from low level to high level at the timing T1 and from high level to low level at the timing T3. The signal line C has the NAND signal level of the signals on the signal lines A and B.

The signal line OH connected to the input terminal NCK of the base-n counter (e.g., N=600) 133 includes only two pulses per frame, so the base-n counter 133 resets the value every frame, and its output terminal NQ holds low level. Since the output terminal NQ connected to the set terminal S of the latch circuit 134 holds low level, the output terminal Q0 of the latch circuit 134 also holds low level. The signal line N has a signal level inverted from that at the output terminal Q0 and therefore holds high level.

The signal line G has the AND signal level of the signals on the signal lines N and C and therefore has the same signal level as that on the signal line C. The input line E of the inverter 76*a* goes low when the signal at the terminal SS is at high level, and has the same signal level as that on the signal line G when the signal at the terminal SS is at low level. The output line F of the inverter 76*a* has a signal level inverted from that on the input line E.

The scanning line L1 has the same signal level as that on the output line GL1 when the signal line E is at high level, and goes low when the signal line E is at low level. Similarly, the scanning line L2 has the same signal level as that on the output line GL2 when the signal line E is at high level, and goes low when the signal line E is at low level.

As a result, the scanning line L1 outputs a pulse at the timing T1, as in FIG. 14. However, for the scanning line L2, since the output line GL2 is short-circuited to the power supply line and disconnected, no pulse is output at the timing T2 when a pulse should be output. Instead, at the timing T2, a normal scanning signal is supplied from the output line GR2 of the second scanning driver 71*b* to the scanning line R2 in the display area 2, so normal display is performed.

FIG. 16 is a timing chart showing operation when the neighboring (consecutive) output lines GL2 and GL3 of the scanning driver 71*a* are short-circuits to the power supply line and fixed at high level in the liquid crystal display device according to the fourth embodiment.

A pulsed check signal is supplied to the check input terminal Lin. Only the output lines GL2 and GL3 are fixed at high level, and the remaining output lines GL0, GL1, and GL4 to GLn+1 sequentially output normal pulsed scanning signals.

Since the signal line H1 has the AND signal level of the signals on the output lines GL1 and GL2, a pulse is output at the timing T1. The signal line H2 has the AND signal level of the signals on the output lines GL2 and GL3 and therefore holds high level.

Since the signal line H2 holds high level, the transistor 75*a* connected to the signal line H2 holds the ON state, and the signal line OH has the same signal level as that of the signal at the check input terminal Lin. The signals at the terminals RS and SS are the same as those shown in FIG. 14.

The clock terminal CK of the D flip-flop 87 has the same signal level as that on the signal line OH. The input terminal DF of the D flip-flop 87 inverts the signal level in accordance with the second and subsequent leading edges of the signal at the clock terminal CK.

A signal inverted from that on the signal line OH is supplied to the input line A. The signal level on the input signal line B is inverted in accordance with the leading edge of the signal at the clock terminal CK. The signal line C has the NAND signal level of the signals on the signal lines A and B.

When the horizontal resolution of the display area 2 is 600 (n=600), the signal line OH connected to the input terminal NCK of the base-n counter (N= 600) 133 includes 600 pulses per frame. Hence, the base-n counter 133 counts the 600th pulse on the signal line OH at a timing Tn, so the output terminal NQ changes from low level to high level.

Since the output terminal NQ is connected to the set terminal S of the latch circuit 134, the output terminal Q0 of the latch circuit 134 outputs a signal 141 in the first frame and a signal 142 in the second and subsequent frames. The signal 141 of the first frame changes from low level to high level at the timing Tn in accordance with the leading edge of the signal at the output terminal NQ of the base-n counter 133. The signal 142 of the second and subsequent frames continuously holds high level. From the second frame, the signal line N has a signal level inverted from that at the output terminal Q0 and therefore holds low level.

The signal line G has the AND signal level of the signals on the signal lines N and C and thus goes low. The input line E of the inverter 76*a* goes low when the terminal SS has a high-level signal, and has the same signal level as that on the signal line G when the terminal SS has a low-level signal. As a result, the signal line E holds low level. The output line F of the inverter 76*a* has a signal level inverted from that on the input line E and therefore holds high level.

The scanning line L1 has the same signal level as that on the output line GL1 when the signal line E is at high level, and goes low when the signal line E is at low level. Hence, the scanning line L1 outputs no pulse at the timing T1 when a pulse should be output, and holds low level. The scanning line L2 has the same signal level as that on the output line GL2 when the signal line E is at high level, and goes low when the signal line E is at low level. Hence, the scanning line L2 outputs no pulse at the timing T2 when a pulse should be output, and holds low level.

That is, all the output lines GL1 to GLn of the first scanning driver 71*a* are disconnected from the display area 2, and no pulses are supplied from the first scanning driver 71*a* to the scanning lines L1 to Ln. Instead, normal scanning signals are supplied from the second scanning driver 71*b* to all the scanning lines R1 to Rn in the display area 2, and normal display is performed.

According to the fourth embodiment, when two or more neighboring output lines, e.g., the output lines GL2 and GL3, among the output lines GL0 to GLn+1 are fixed at high level, all the output lines GL1 to GLn of the first scanning driver 71*a* are disconnected from all the scanning lines L1 to Ln in the display area 2 by the switching transistors. Instead, the second scanning driver 71*b* supplies scanning signals to all the scanning lines R1 to Rn in the display area 2 through the output lines GR1 to GRn, respectively. Hence, the liquid crystal display device can perform normal display on all the lines.

(Fifth Embodiment)

Figure 17:
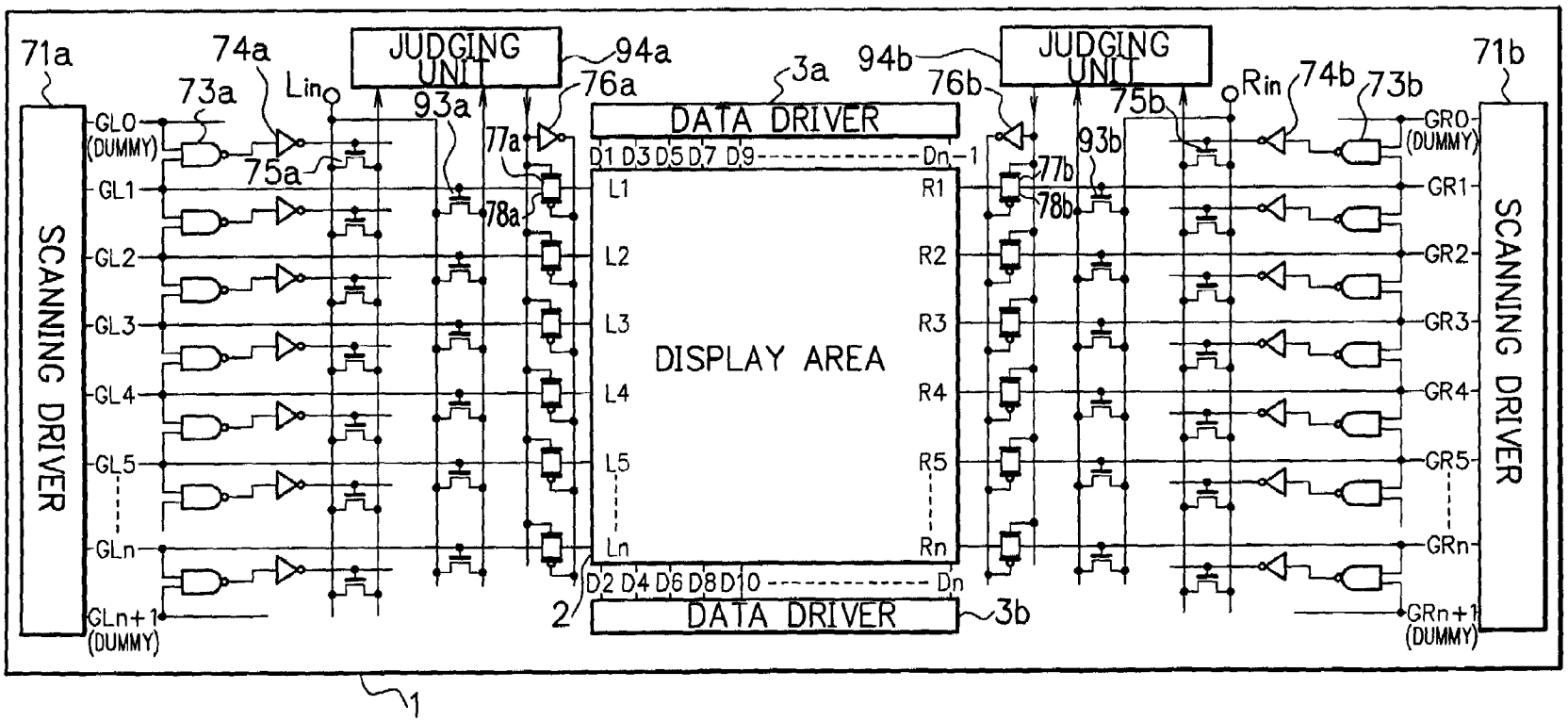
FIG. 17 is a block diagram showing the structure of a liquid crystal display device according to the fifth embodiment of the present invention.

FIG. 17 is a block diagram showing the structure of a liquid crystal display device according to the fifth embodiment of the present invention. In the fifth embodiment, the second embodiment (FIG. 8) and the third embodiment (FIG. 9) are integrated. In the fifth embodiment, when a defect is generated, with which an output line in first or second scanning driver 71*a* or 71*b* short-circuits to the ground line or power supply line or is unfixed and is fixed at low or high level, the defect can be detected and automatically corrected.

A glass substrate 1, a display area 2, data drivers 3*a* and 3*b*, scanning drivers 71*a* and 71*b*, NAND circuits 73*a* and 73*b*, inverters 74*a*, 74*b*, 76*a*, and 76*b*, and MOS transistors 75*a*, 75*b*, 77*a*, 77*b*, 78*a*, and 78*b* are the same as those shown in the third embodiment (FIG. 9). Check n-channel MOS transistors 93*a* and 93*b* correspond to the check n-channel MOS transistors 7*a* and 7*b* in the second embodiment (FIG. 8).

A judging unit 94*a* receives signals from the sources of the n-channel MOS transistors 75*a* and the sources of the n-channel MOS transistors 93*a* and outputs signals to the gates of the n-channel MOS transistors 77*a* and the input terminal of the inverter 76*a*. A judging unit 94*b* has the same structure as that of the judging unit 94*a*.

Figure 18:
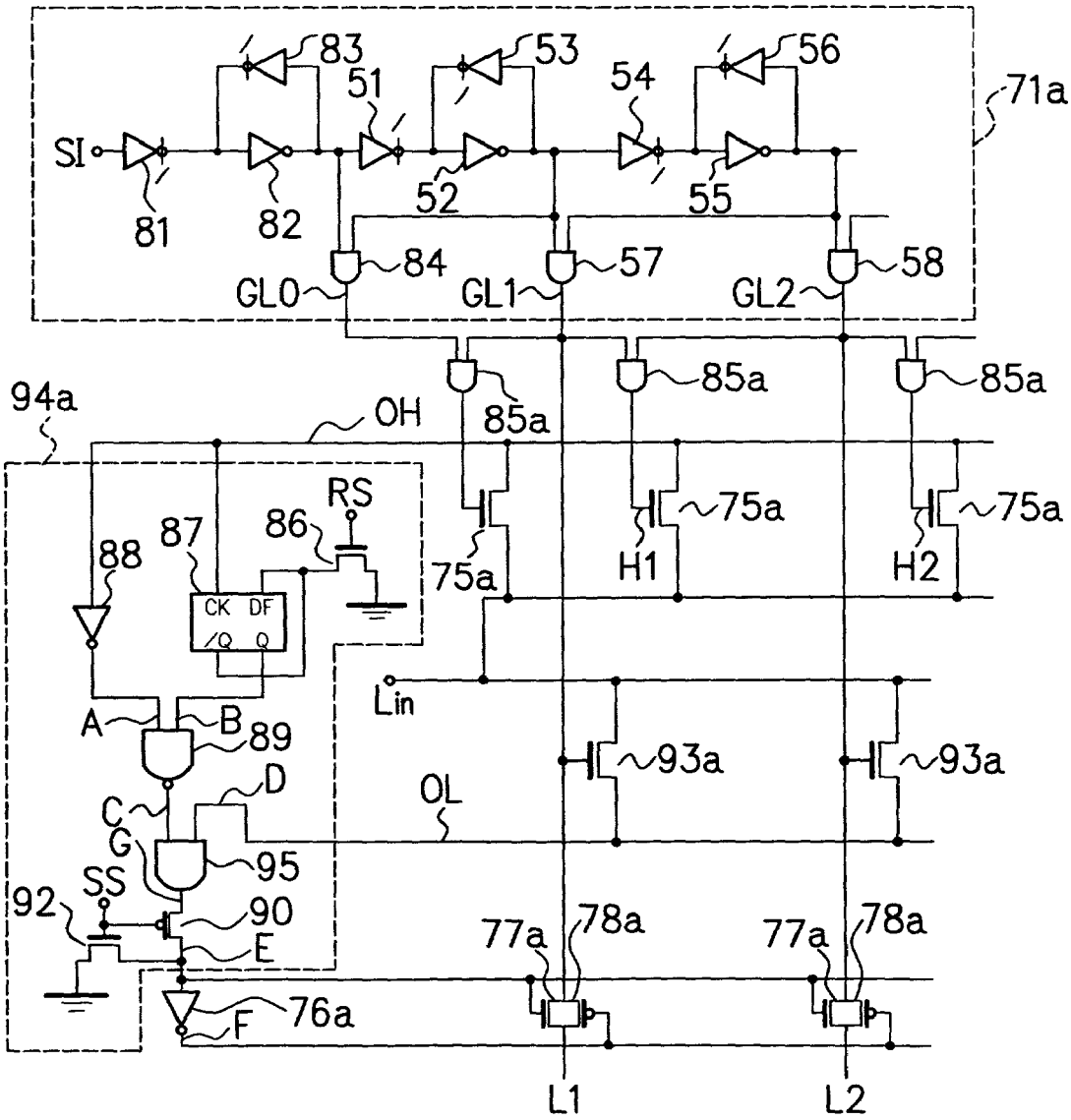
FIG. 18 is a circuit diagram of a judging unit according to the fifth embodiment of the present invention and its peripheral portion.

FIG. 18 is a circuit diagram of the judging unit 94*a* shown in FIG. 17 and its peripheral portion. The judging unit 94*a* and its peripheral circuits will be described below. This also applies to the judging unit 94*b* and its peripheral circuits. The scanning driver 71*a* is the same as that shown in the third embodiment (FIG. 10).

AND circuits 85*a* correspond to the combinations of the NAND circuits 73*a* and the inverters 74*a* in FIG. 17. The same reference numerals as in FIG. 17 denote the same elements as in FIG. 17.

The judging unit 94*a* additionally has an AND circuit 95, unlike the judging unit 72*a* shown in the third embodiment (FIG. 10). The AND circuit 95 has one input line C connected to the output of a NAND circuit 89 and the other input line D connected to the sources of the n-channel MOS transistors 93*a* through a signal line OL. The output of the AND circuit 95 is connected to the source of a p-channel MOS transistor 90. An n-channel MOS transistor 92 is connected in the same way as in the third embodiment (FIG. 10).

Figure 19:
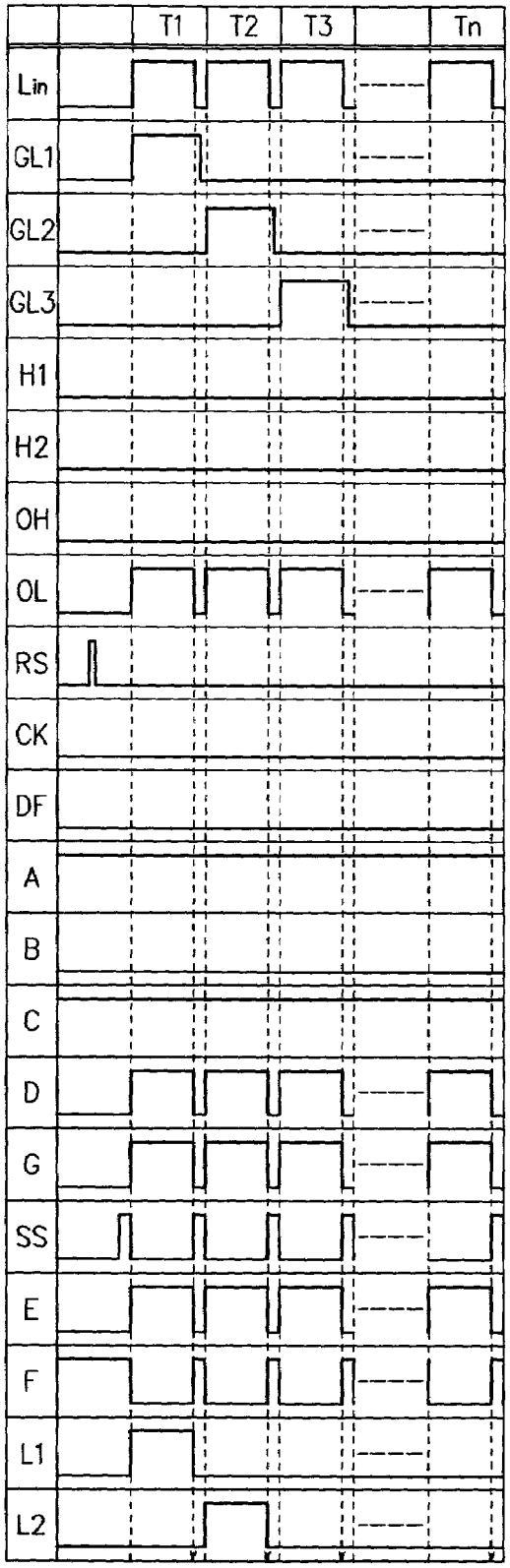
FIG. 19 is a timing chart showing operation when the liquid crystal display device according to the fifth embodiment is normal.
Figure 20:
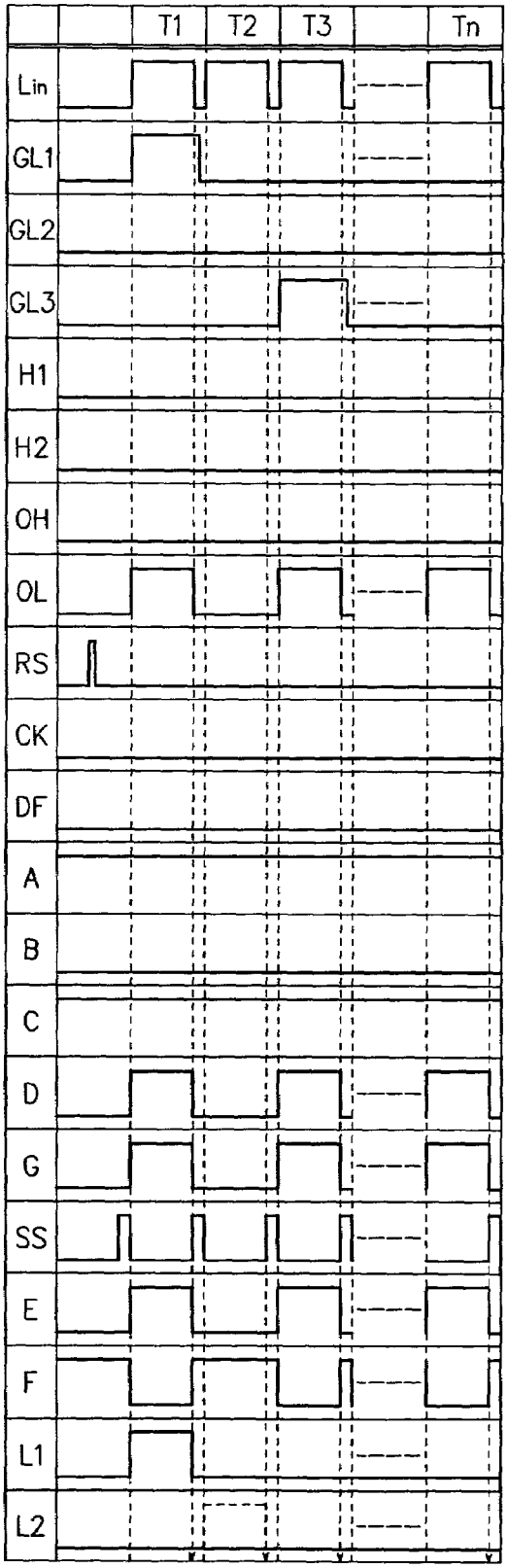
FIG. 20 is a timing chart showing operation when a scanning line in a scanning driver of the liquid crystal display device according to the fifth embodiment is fixed at low level.
Figure 21:
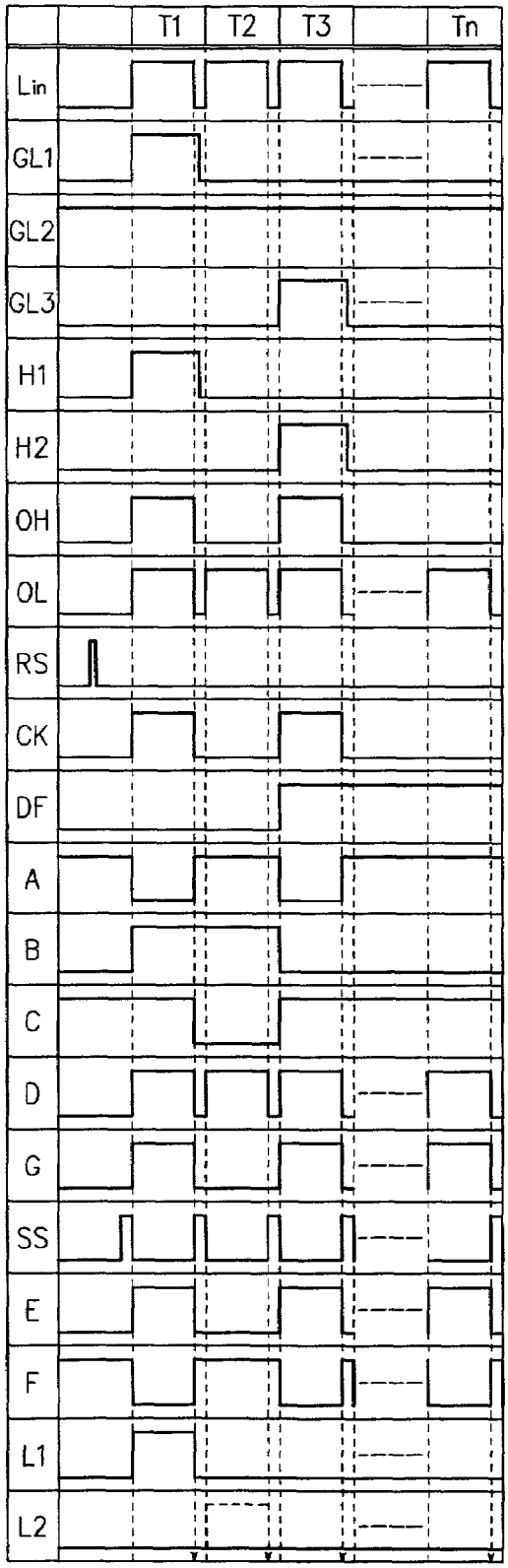
FIG. 21 is a timing chart showing operation when a scanning line in a scanning driver of the liquid crystal display device according to the fifth embodiment is fixed at high level.
Figure 22:
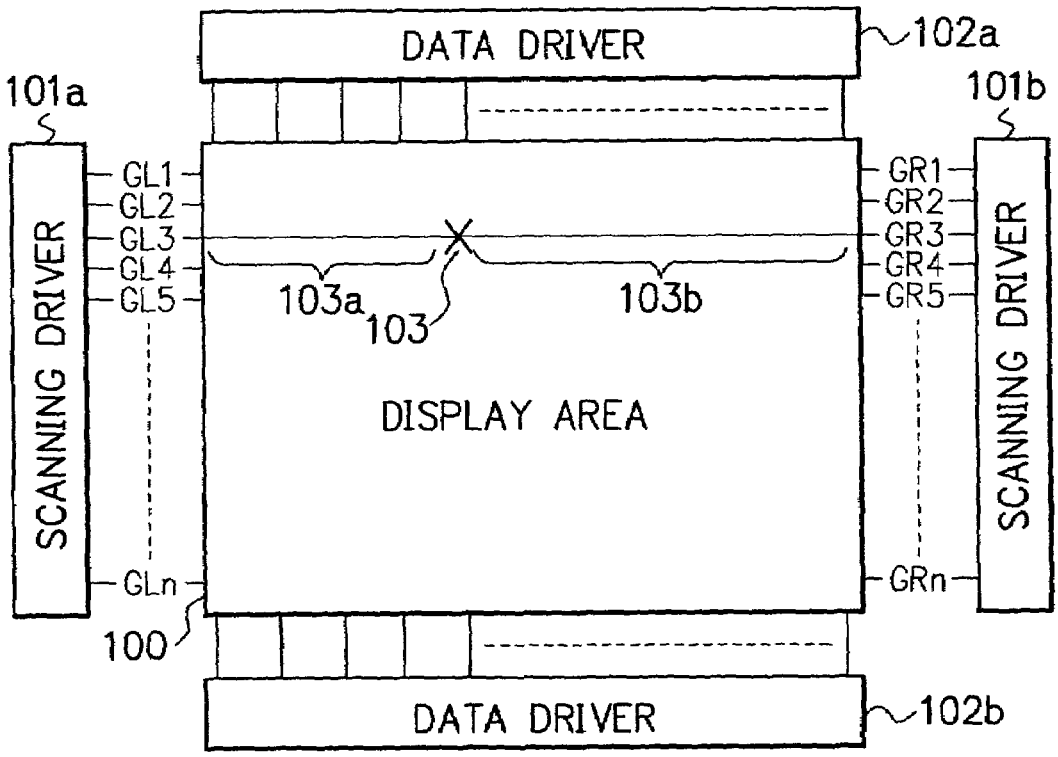
F I G. 22 PRIOR ART
FIG. 22 is a block diagram showing a case wherein the display area of a liquid crystal display device according to the first prior art has a defect.
Figure 23:
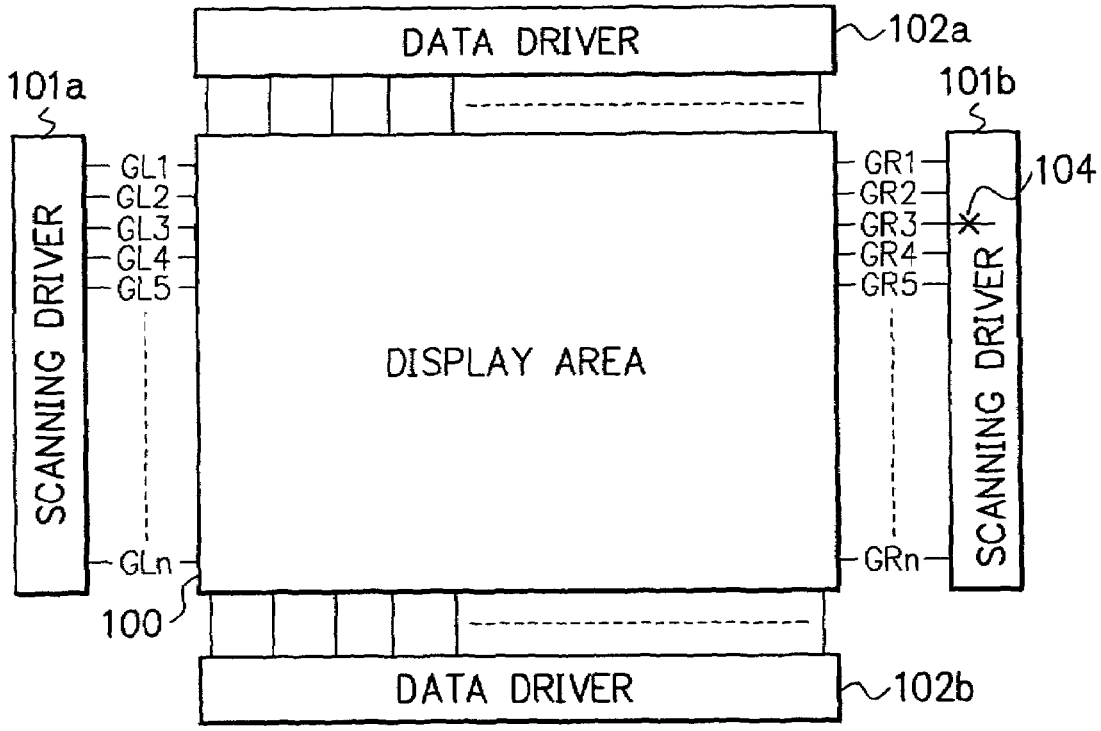
F I G. 23 PRIOR ART
FIG. 23 is a block diagram showing a case wherein a scanning driver of the liquid crystal display device according to the first prior art has a defect.
Figure 24:
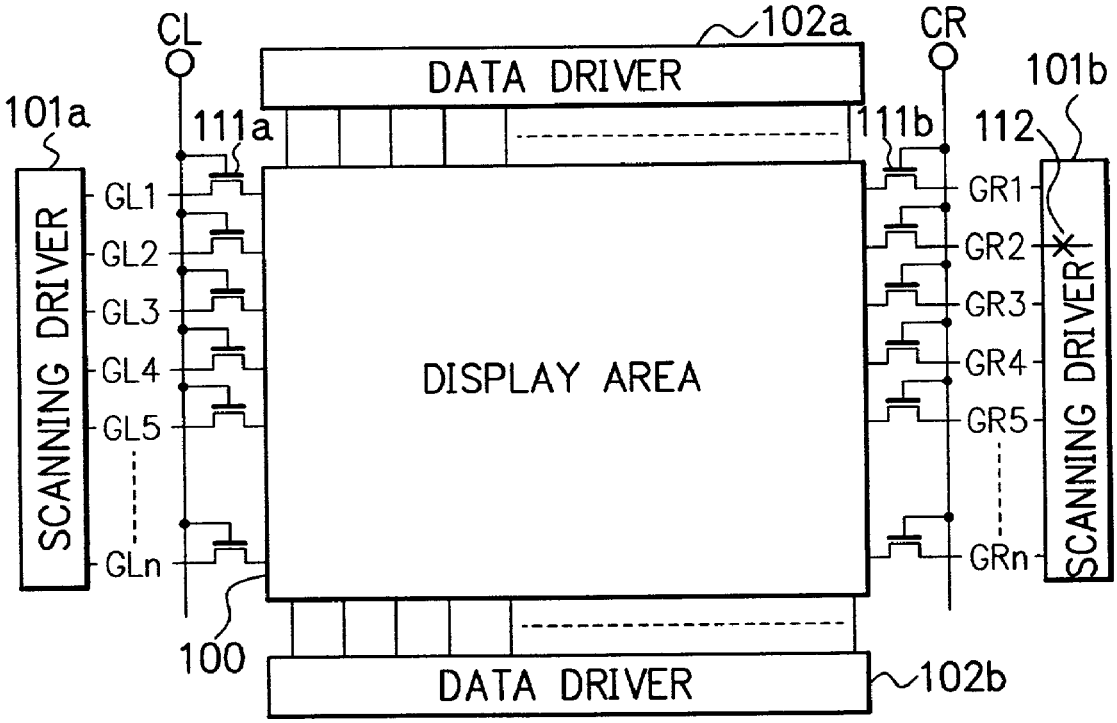
FIG. 24 PRIOR ART
FIG. 24 is a block diagram showing a case wherein a scanning driver of a liquid crystal display device according to the second prior art has a defect.

FIG. 19 is a timing chart showing the operation of the liquid crystal display device according to the fifth embodiment when the liquid crystal display device has no defect. FIGS. 19 to 21 show the timing on the first scanning driver 71*a* side. The timing on the second scanning driver 71*b* side is the same as in FIGS. 19 to 21.

Pulsed check signals are supplied to check input terminals Lin and Rin, as in the first embodiment (FIG. 7). Output lines GL0 to GLn+1 and GR0 to GRn+1 sequentially output normal pulsed scanning signals.

A signal line H1 has the AND signal level of the signals on the output lines GL1 and GL2 and therefore holds low level. A signal line H2 has the AND signal level of the signals on the output lines GL2 and GL3 and therefore holds low level. Since the signal lines H1, H2, and the like hold low level, all the transistors 75*a* are turned off, so the signal line OH holds low level.

Since the transistors 93*a* are turned on in accordance with the pulses on the output lines GL1, GL2, GL3, and the like, the same signal as the signal at the check input terminal Lin appears on the signal line OL connected to the sources of the transistors 93*a*. The same signals as in the third embodiment (FIG. 11) are supplied to terminals RS and SS.

A clock terminal CK of a D flip-flop 87 has the same signal level as that on the signal line OH and holds low level. When a reset signal is input to the reset terminal RS, an input terminal DF of the D flip-flop 87 holds low level.

An input line A has a signal inverted from that on the signal line OH and holds high level. An input line B is connected to an output terminal Q of the D flip-flop 87 and holds low level.

The signal line C has the NAND signal level of the signals on the signal lines A and B and therefore holds high level. The signal line D has the same signal level as that on the signal line OL. A signal line G has the AND signal level of the signals on the signal lines C and D and therefore has the same signal level as on the signal line D. An input line E of the inverter 76*a* goes low when the terminal SS has a high-level signal, and has the same signal level as that on the signal line G when the terminal SS has a low-level signal. An output line F of the inverter 76*a* has a signal level inverted from that on the input line E.

A scanning line L1 has the same signal level as that on the output line GL1 when the signal line E is at high level, and goes low when the signal line E is at low level. Hence, a pulse is output at a timing T1. Similarly, a scanning line L2 has the same signal level as that on the output line GL2 when the signal line E is at high level, and goes low when the signal line E is at low level. Hence, a pulse is output at a timing T2.

Consequently, the scanning signals on the output lines GL1 to GLn are normally supplied to the scanning lines L1 to Ln. Similarly, the scanning signals on the output lines GR1 to GRn are normally supplied to the scanning lines R1 to Rn.

FIG. 20 is a timing chart showing operation when the output line GL2 of the scanning driver 71*a* is short-circuited to the ground line and fixed at low level or is disconnected and unfixed in the liquid crystal display device according to the fifth embodiment.

A pulsed check signal is supplied to the check input terminal Lin. Only the output line GL2 is fixed at low level, and the remaining output lines GL0, GL1, and GL3 to GLn+1 sequentially output normal pulsed scanning signals.

The signal line H1 has the AND signal level of the signals on the output lines GL1 and GL2 and therefore holds low level. The signal line H2 has the AND signal level of the signals on the output lines GL2 and GL3 and therefore holds low level. Since the signal lines H1, H2, and the like hold low level, all the transistors 75*a* are turned off, so the signal line OH holds low level.

The signal line OL has the same signal level as that at the check input terminal Lin when the output lines GL1, GL2, GL3, and the like are at high level. As a result, the signal line OL holds low level at the timing T2 and outputs a pulse at the remaining timings T1 and T3 to Tn. The signals at the terminals RS and SS are the same as in FIG. 19.

The clock terminal CK of the D flip-flop 87 has the same signal level as that on the signal line OH and holds low level. The input terminal DF of the D flip-flop 87 holds low level in accordance with the reset signal at the reset terminal RS.

The input line A has a signal inverted from that on the signal line OH and holds high level. The input line B is connected to the output terminal Q of the D flip-flop 87 and holds low level. One input line C of the AND circuit 95 has the NAND signal level of the signals on the signal lines A and B and holds high level. The other signal line D has the same signal level as that on the signal line OL. The signal line G has the AND signal level of the signals on the input lines C and D and therefore has the same signal level as on the input line D.

The input line E of the inverter 76*a* goes low when the terminal SS has a high-level signal, and has the same signal level as that on the signal line G when the terminal SS has a low-level signal. The output line F of the inverter 76*a* has a signal level inverted from that on the input line E.

The scanning line L1 has the same signal level as that on the output line GL1 when the signal line E is at high level, and goes low when the signal line E is at low level. Hence, a pulse is output at the timing T1. The scanning line L2 has the same signal level as that on the output line GL2 when the signal line E is at high level, and goes low when the signal line E is at low level. However, no pulse is output at the timing T2 when a pulse should be output.

Consequently, the normal scanning signals on the output lines GL1 and GL3 to GLn are supplied to the scanning lines L1 and L3 to Ln. For the scanning line L2, however, since the output line GL2 is short-circuited to the ground line, no pulse is output a the timing T2 when a pulse should be output. Instead, at the timing T2, a normal scanning signal is supplied from the second scanning driver 71*b* to the scanning line R2 in the display area 2, and normal display is performed.

FIG. 21 is a timing chart showing operation when the output line GL2 of the scanning driver 71*a* is short-circuited to the power supply line and fixed at high level in the liquid crystal display device according to the fifth embodiment.

A pulsed check signal is supplied to the check input terminal Lin. Only the output line GL2 is fixed at high level, and the remaining output lines GL0, GL1, and GL3 to GLn+1 sequentially output normal pulsed scanning signals.

Since the signal line Hi has the AND signal level of the signals on the output lines GL1 and GL2, a pulse is output at the timing T1. Since the signal line H2 has the AND signal level of the signals on the output lines GL2 and GL3, a pulse is output at the timing T3. The signal line OH has the same signal level as that of the signal of the check input terminal Lin when the signal on the signal line H1 or H2 goes high. As a consequence, the signal line OH outputs a pulse at the timings T1 and T3. Since the output line GL2 is fixed at high level, the transistors 93*a* hold the ON state, and the same signal as that at the check input terminal Lin is output to the signal line OL. The signals at the terminals RS and SS are the same as those shown in FIG. 19.

The clock terminal CK of the D flip-flop 87 has the same signal level as that on the signal line OH. The input terminal DF of the D flip-flop 87 changes from low level to high level at the timing T3 in accordance with the second leading edge of the signal at the clock terminal CK.

A signal inverted from the signal on the signal line OH is supplied to the input line A. The signal level on the input line B is inverted in accordance with the leading edge of the signal at the clock terminal CK of the D flip-flop 87. Hence, the signal level changes from low level to high level at the timing T1 and from high level to low level at the timing T3.

One input line C of the AND circuit 95 has the NAND signal level of the signals on the signal lines A and B and holds low level during the period of timing T2. The other input line D has the same signal level as that of the signal on the signal line OL. The signal line G has the AND signal level of the signals on the input lines C and D.

The input line E of the inverter 76*a* goes low when the signal at the terminal SS is at high level, and has the same signal level as that on the signal line G when the signal at the terminal SS is at low level. The output line F of the inverter 76*a* has a signal level inverted from that on the input line E.

The scanning line L1 has the same signal level as that on the output line GL1 when the signal line E is at high level, and goes low when the signal line E is at low level. Similarly, the scanning line L2 has the same signal level as that on the output line GL2 when the signal line E is at high level, and goes low when the signal line E is at low level. As a result, the scanning line L1 outputs a pulse at the timing T1. However, for the scanning line L2, since the output line GL2 is short-circuited to the power supply line, no pulse is output at the timing T2 when a pulse should be output. Instead, at the timing T2, a normal scanning signal is supplied from the output line GR2 of the second scanning driver 71*b* to the scanning line R2 in the display area 2, so normal display is performed.

According to the fifth embodiment, even when a defect is generated to short-circuit an output line of the first or second scanning driver 71*a* or 71*b* to the ground line and fix the output line at low level, or a defect is generated to short-circuit an output line to the power supply line and fix the output line at high level, these defects can be detected and automatically corrected. Hence, the liquid crystal display device can perform normal display on all lines.

The judging unit 72*a* (FIG. 13) of the liquid crystal display device according to the fourth embodiment may be applied to the liquid crystal display device (FIG. 17) according to the fifth embodiment. In this case, for example, when two or more neighboring output lines of the first scanning driver 71*a* are fixed at high or low level, all the output lines GL1 to GLn of the first scanning driver 71*a* are disconnected from all the scanning lines L1 to Ln in the display area 2 by switching transistors, so scanning signals can be supplied from the second scanning driver 71*b* to all the scanning lines R1 to Rn in the display area 2.

As has been described above, according to the first and second embodiments, when an output line of the scanning driver is short-circuited to the ground line and fixed at low level, or disconnected and unfixed, the fixed or unfixed output line can be detected and automatically corrected. According to the third and fourth embodiments, when an output line of the scanning driver is short-circuited to the power supply line and fixed at high level, the fixed or unfixed output line can be detected and automatically corrected. According to the fifth embodiment, when an output line of the scanning driver is short-circuited to the ground line or power supply line and fixed at low or high level, or disconnected and unfixed, the fixed or unfixed output line can be detected and automatically corrected.

According to the fourth embodiment, when the judging unit determines that the potentials of two or more neighboring output lines of the first scanning driver are fixed, the switching transistors can disconnect all the output lines of the first scanning driver from all the scanning lines in the display area, and all the scanning signals can be supplied from the second scanning driver to the display area. In addition, when it is determined that the potentials of two or more neighboring output lines of the second scanning driver are fixed, all the output lines of the second scanning driver can be disconnected from all the scanning lines in the display area, and all the scanning signals can be supplied from the first scanning driver to the display area. Thus, the liquid crystal display device can perform normal display.

Figure 25:
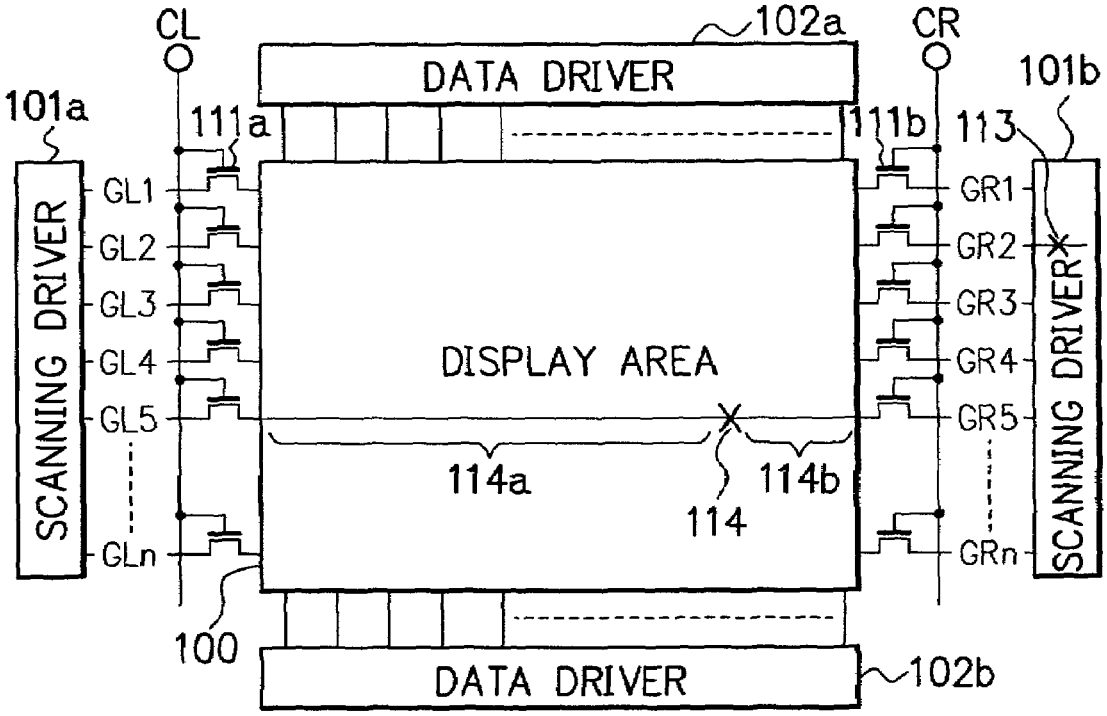
FIG. 25 PRIOR ART
FIG. 25 is a block diagram showing a case wherein the display area and scanning driver of the liquid crystal display device according to the second prior art have defects.
Figure 26:
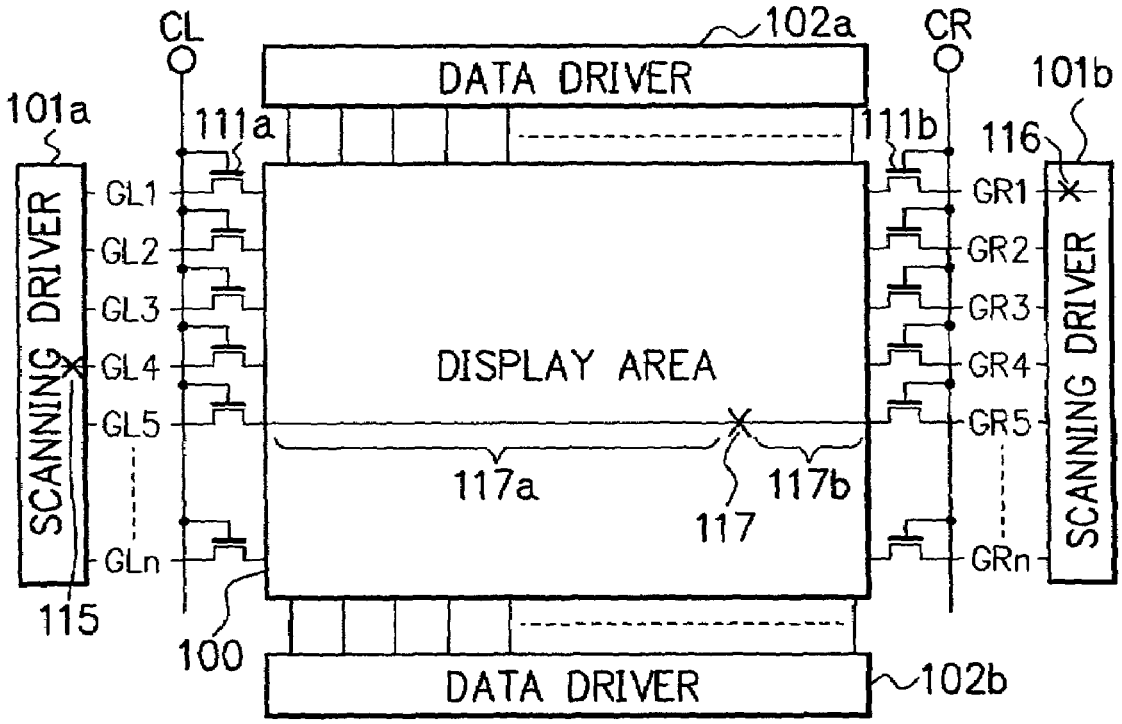
F I G. 26 PRIOR ART
FIG. 26 is a block diagram showing a case wherein the display area and first and second scanning drivers of the liquid crystal display device according to the second prior art have defects.
Figure 27:
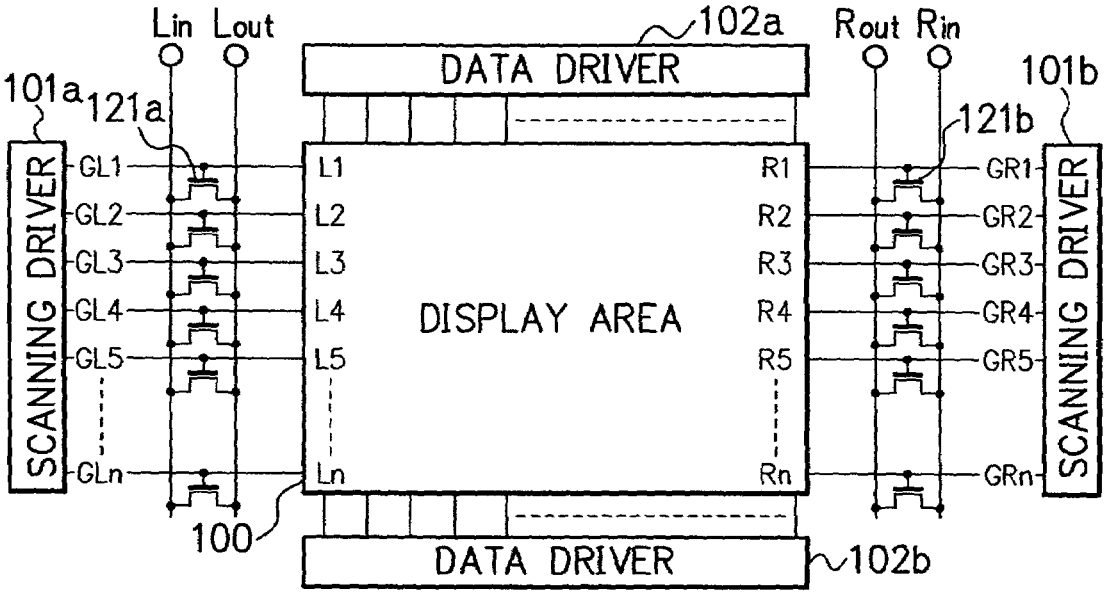
F I G. 27 PRIOR ART
FIG. 27 is a block diagram showing the structure of a liquid crystal display device according to the third prior art.

According to the first to fifth embodiments, when the potential of an output line of the first or second scanning driver is fixed, only the fixed output line can be disconnected from the corresponding scanning line in the display area. For example, when an output line of the first scanning driver is disconnected from the corresponding scanning line in the display area, a normal scanning signal is supplied from the corresponding output line of the second scanning driver to the scanning line in the display area. Instead of disconnecting all the output lines of the first or second scanning driver from all the scanning lines in the display area, only the output line with the fixed potential can be disconnected from the scanning line in the display area. For this reason, the normal output lines of the first or second scanning driver and the scanning lines in the display area are connected, so normal display can be performed. In addition, since it is determined individually for the first and second scanning drivers whether the potential of an output line is fixed, and the output lines are individually disconnected from the scanning lines as needed, even defects as shown in FIGS. 25 and 26 can be corrected. That is, even when defects are present at portions, e.g., both of the first or second scanning driver and the display area have defects, or the first and second scanning drivers and display area have defects, the defects can be reliably detected and automatically corrected, so normal display can be performed.

Since the automatic correction is possible, the yield of liquid crystal display devices can be increased, the productivity can be improved, and the cost of liquid crystal display devices can be reduced.

A case in which the defective/non-defective state of a scanning signal in the first and second scanning drivers is determined, and the output line and scanning line are disconnected in accordance with the determination result has been described. The same implementation may be applied to the first and second data drivers. More specifically, the first and second data drivers may supply identical data signals to the display area, the defective/non-defective state of a data signal in the first and second data drivers may be determined, and the data line between the data driver and the display area may be disconnected in accordance with the determination result.

The above embodiments are merely examples of the present invention and should not be construed to limit the technical range of the present invention. That is, the present invention can be practiced in various forms without departing from its technical spirit and scope or major features.

What is claimed is:

1. A display device comprising:

a display section with scanning lines;

a scanning driver including output lines for supplying scanning signals to said scanning lines of said display section;

a judging unit for judging as to whether or not each of said scanning signals supplied from said scanning driver is defective, and for outputting the judging result; and a switching unit for disconnecting the output line for supplying a scanning signal that said judging unit has judged as being defective, from the corresponding scanning line of said display section.

2. The device according to claim 1, wherein said judging unit judges as to whether or not at least one of said output lines of said scanning driver is fixed at a ground potential, and, when said judging unit has judged that at least one of said output lines of said scanning driver is fixed at said ground potential, said switching unit disconnects the fixed output line from the corresponding scanning line of said display section.

3. The device according to claim 1, wherein said judging unit judges as to whether or not at least one of said output lines of said scanning driver is fixed at a power supply potential, and, when said judging unit has judged that at least one of said output lines of said scanning driver is fixed at said power supply potential, said switching unit disconnects the fixed output line from the corresponding scanning line of said display section.

4. The device according to claim 1, wherein said judging unit judges as to whether or not at least one of said output lines of said scanning driver is disconnected, and, when said judging unit has judged that at least one of said output lines of said scanning driver is disconnected, said switching unit disconnects the disconnected output line from the corresponding scanning line of said display section.

5. The device according to claim 1, wherein said switching unit disconnects all of said output lines of said scanning driver from all of said scanning lines of said display section when said judging unit has judged that at least two neighboring output lines of said scanning driver are defective.

6. The device according to claim 1, wherein said judging unit comprises a check transistor with its gate, source, and drain, said gate receiving a signal corresponding to the scanning signal on an output line of said scanning driver, and a judging section for checking as to whether or not a check signal is transmitted between said source and drain of said check transistor in response to said signal supplied to said gate of said check transistor, so as to judge as to whether or not said scanning signal on said output line of said scanning driver is defective.

7. The device according to claim 6, wherein said gate of said check transistor is connected to said output line of said scanning driver.

8. The device according to claim 6, wherein said judging unit further comprises an AND circuit for performing an AND operation in relation to the scanning signals on two neighboring output lines of said scanning driver, said AND circuit having its output connected to said gate of said check transistor.

9. The device according to claim 6, wherein said switching unit comprises a transistor for disconnecting an output line of said scanning driver from the corresponding scanning line of said display section.

10. The device according to claim 9, wherein said switching unit comprises a CMOS transistor made up from an n-channel MOS transistor and a p-channel MOS transistor for disconnecting an output line of said scanning driver from the corresponding scanning line of said display section.

11. The device according to claim 10, wherein the gate of said n-channel MOS transistor is supplied with an output of said judging unit, the gate of said p-channel MOS transistor is supplied with the logically inverted signal of said output of said judging unit, and the sources and drains of said n- and p-channel MOS transistors are connected to said output line of said scanning driver and said scanning line of said display section.

12. The device according to claim 9, wherein said display section, said scanning driver, said judging unit, and said switching unit are integrated on a single substrate.

13. The device according to claim 12, wherein said substrate is a glass substrate.

14. The device according to claim 13, wherein said display section comprises a transistor, and each of said transistor of said display section, said check transistor of said judging unit, and said transistor of said switching unit is a polysilicon thin-film transistor.

15. The device according to claim 1, wherein said display section has data lines, and said device further comprises first and second data drivers connected to said data lines of said display section for supplying data signals to said display section.

16. The device according to claim 15, further comprising:

a data signal judging unit for judging as to whether or not the data signal supplied from at least one of said first and second data drivers is defective, and for outputting the judging result, and a data line switching unit for disconnecting the data line for supplying a data signal that said data signal judging unit has judged as being defective, from the corresponding data line of said display section.

17. The device according to claim 1, wherein said display section has data lines, and said device further comprises a data driver connected to said data lines of said display section for supplying data signals to said display section.

18. The device according to claim 17, wherein said data driver comprises a first data driver section for supplying data signals to some of said data lines of said display section, and a second data driver section for supplying data signals to the other of said data lines of said display section.

19. A liquid crystal display panel filled with liquid crystal material between a pair of substrates comprising:

a display section with scanning lines;

a scanning driver including output lines for supplying scanning signals to said scanning lines of said display section;

a judging unit for judging as to whether or not each of said scanning signals supplied from said scanning driver is defective, and for outputting the judging result; and a switching unit for disconnecting the output line for supplying a scanning signal that said judging unit has judged as being defective, from the corresponding scanning line of said display section.

20. A driving method of a display device comprising a display section with scanning lines, and a scanning driver including output lines for supplying scanning signals to said scanning lines of said display section, said method comprising the steps of:

(a) judging as to whether or not each of said scanning signals supplied from said scanning driver is defective; and (b) disconnecting the output line for supplying a scanning signal that has been judged as being defective, from the corresponding scanning line of said display section.

* * * * *